US005131655A

United States Patent [19]

Ugawa

[11] Patent Number: 5,131,655

[45] Date of Patent: Jul. 21, 1992

[54] FLIPPED BALL GAME APPARATUS

[75] Inventor: Shohachi Ugawa, Gunma, Japan

[73] Assignee: Kabushiki Kaisha Sankyo, Kiryu, Japan

[21] Appl. No.: 721,772

[22] Filed: Jun. 28, 1991

[30] Foreign Application Priority Data

Jul. 2, 1990 [JP] Japan ..... 2-175802

[51] Int. Cl.[5] ..... A63F 7/30

[52] U.S. Cl. ..... 273/121 B; 273/118 A; 273/119 A; 273/120 A; 273/121 A; 273/122 A; 273/123 A; 273/124 A; 273/125 A

[58] Field of Search ..... 273/118 R, 118 A, 118 D, 273/119 R, 119 A, 120 R, 120 A, 121 R, 121 A, 121 B, 122 R, 122 A, 123 R, 123 A, 124 R, 124 A, 125 R, 125 A, 129 R

[56] References Cited

FOREIGN PATENT DOCUMENTS 0074937 7/1978 Japan ..... 273/121 B
0083838 7/1978 Japan ..... 273/121 B
0083839 7/1978 Japan ..... 273/121 B
0085639 7/1978 Japan ..... 273/121 B

*Primary Examiner*—William H. Grieb
*Assistant Examiner*—Raleigh W. Chiu
*Attorney, Agent, or Firm*—Lowe, Price, LaBlanc & Becker

[57] ABSTRACT

A flipper ball game apparatus includes: a ball shooting mechanism for shooting a ball into a playfield; starting condition determiner for determining satisfaction of game starting conditions satisfied by operation of a start button by a player under such conditions, for example, that coins are deposited into the apparatus; and a shooting mechanism automatically controller responsive to a determination output of the starting condition determiner for driving the ball shooting mechanism to automatically flip and shoot the ball. This structure enables the pinball to be automatically flipped into the playfield without any shooting operation conducted by the player.

64 Claims, 20 Drawing Sheets

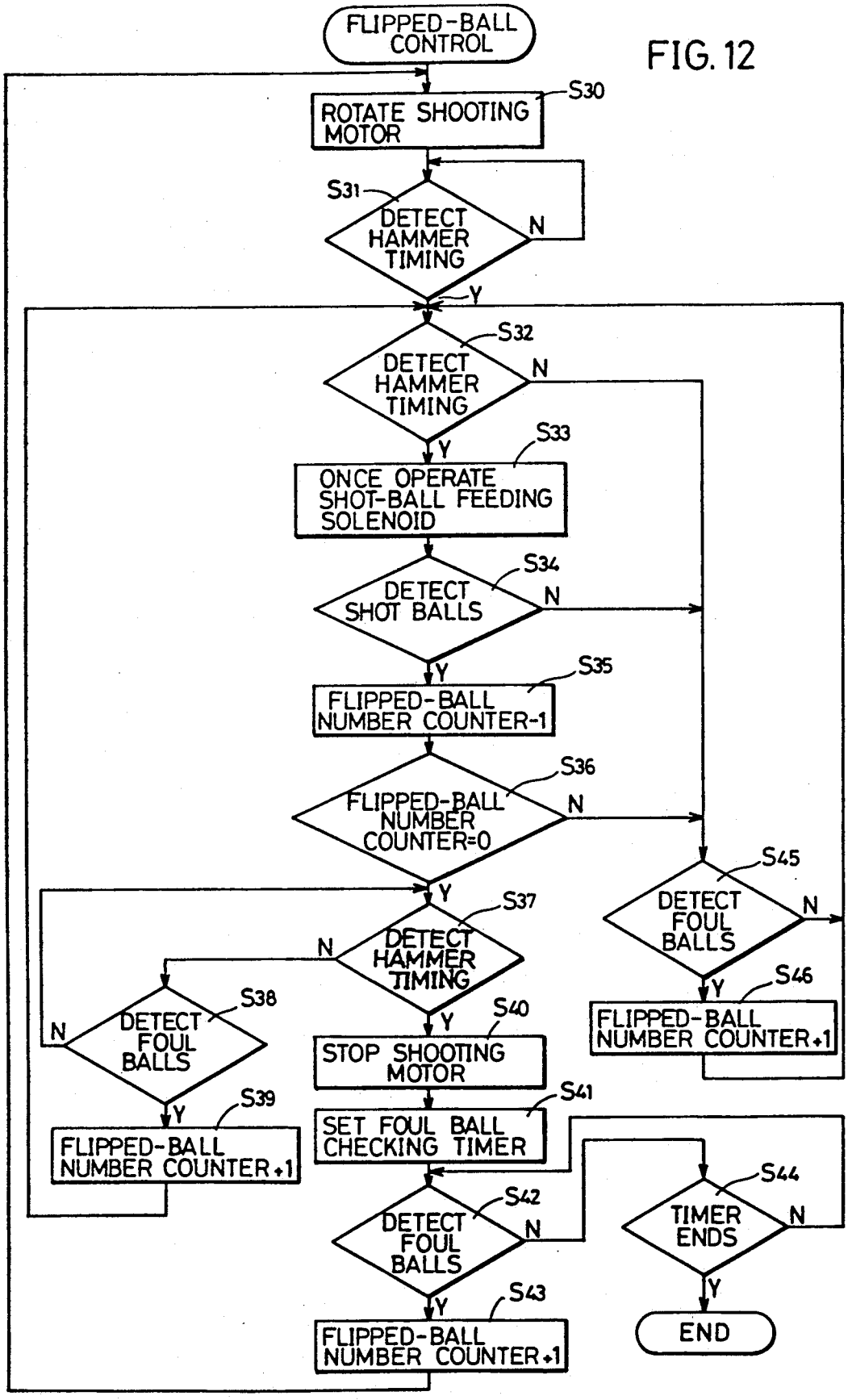
FLIPPED-BALL CONTROL
FIG. 12
S30
ROTATE SHOOTING MOTOR
S31
DETECT HAMMER TIMING
N
Y
S32
DETECT HAMMER TIMING
N
Y
S33
ONCE OPERATE SHOT-BALL FEEDING SOLENOID
S34
DETECT SHOT BALLS
N
Y
S35
FLIPPED-BALL NUMBER COUNTER-1
S36
FLIPPED-BALL NUMBER COUNTER=0
N
Y
S37
DETECT HAMMER TIMING
N
Y
S38
DETECT FOUL BALLS
N
Y
S39
FLIPPED-BALL NUMBER COUNTER+1
S40
STOP SHOOTING MOTOR
S41
SET FOUL BALL CHECKING TIMER
S42
DETECT FOUL BALLS
N
Y
S43
FLIPPED-BALL NUMBER COUNTER+1
S44
TIMER ENDS
N
Y
END
S45
DETECT FOUL BALLS
N
Y
S46
FLIPPED-BALL NUMBER COUNTER+1

FIG. 16

90. 5. 12. 11 : 30 PM

① THE NUMBER OF GAMES PLAYED SINCE DOOR WAS CLOSED ---------- 184

② THE NUMBER OF GAMES PLAYED SINCE POWER WAS SUPPLIED -------- 313

③ THE NUMBER OF GAMES PLAYED WITH ONE-COIN DEPOSIT ---------- 96

④ THE NUMBER OF GAMES PLAYED WITH TWO-COIN DEPOSIT ---------- 31

⑤ THE NUMBER OF GAMES PLAYED WITH THREE-COIN DEPOSIT ---------- 186

⑥ THE ACCOUNT OF GAME MACHINE ---------- 388

⑦ THE NUMBER OF OPENING THE DOOR ---------- 2

FLIPPED BALL GAME APPARATUS

BACKGROUND OF THE INVENTION

1. Field of the Invention

The present invention relates to a flipped ball game apparatus having a playfield into which balls are flipped, to play a game.

2. Description of the Background Art

A game machine called a pinball game machine has conventionally been proposed. This pinball game machine has a playfield in which balls roll down, and a player plays a game by using the rolling balls. When the balls rolling down in the playfield collide with certain obstacles, the balls are flipped and captured at indefinite probabilities while tracing their irregularly changing trajectories, and consequently a predetermined reward is provided to the player.

A conventional pinball game of particular interest to the present invention is a Japanese pinball game of the type called "pachinko" which have been popular in Japan.

Although the present invention is not limited to such a "pachinko" game machine, it is most widely applicable to the "pachinko" game machine.

A large number of such "pachinko" game machines are installed in a game house, and the player goes to the game house and plays a game by using at least one of the "pachinko" game machines. In the game house, the player first buys a plurality of small balls and inserts them into the "pachinko" game machine for playing a game. The inserted balls are flipped one by one into a playfield in the machine by the player's manual operation. A number of protruding obstructive pins are standing in the playfield. The flipped balls fall down tracing their irregularly changing trajectories while colliding with the obstructive pins. In the playfield are further provided winning holes into which the rolling balls fall at indefinite probabilities. If any one of the balls falls into any one of the winning holes, then a predetermined prize ball is dispensed to the player. The player flips the prize ball again into the playfield, so that he or she can play the game again. The player can also preserve a large number of such prize balls and exchange them for some prizes prepared in the game house. The player can acquire prizes of his or her selection if winning the game in the "pachinko" game machine.

FIGS. 17–19 illustrate a pinball game machine which is one example of conventional flipped ball game machines. FIG. 17 is an overall front view of the conventional pinball game machine. FIG. 18 is an overall rear view showing an internal structure of part of the conventional pinball game machine. FIG. 19 is a perspective view showing a ball flipping unit of the conventional pinball game machine. The conventional pinball game machine is disclosed in, for example, Japanese Patent Laying-Open No. 1-254183.

Referring to FIG. 17, a door supporting frame 304 is mounted on a front frame 303 serving as a member constituting a pinball game machine 301. A glass door frame 395 incorporating a glass plate is attached rotatably on door supporting frame 304. This glass door frame 395 opens/closes a playfield 300 formed on the front face of a playboard 306. This playfield is a field in which flipped pinballs fall down leaving certain trajectories. A play value which is predetermined at a certain probability in accordance with the trajectories of the balls in the playfield is provided to a player.

A front plate 321 is provided beneath glass door frame 395. A flipped-ball supplying tray 315 is provided on the front face of front plate 321. This supply tray 315 has such form that pinballs can temporarily be stored therein. In a game play, the player first deposits coins into a pinball lending machine installed in a predetermined place in a game house and borrows pinballs by conducting a predetermined operation for the machine. Then, the player deposits the lent pinballs into supply tray 315. The player then holds and turns by his/her right hand a flipping operation handle 320 provided in a lower part of pinball game machine 301. With the turning operation of handle 320, the pinballs stored in supply tray 315 are flipped into playfield 300 one by one by action of a ball shooting unit 305 (see FIG. 18).

A variable display unit 307 is mounted in a central position of playfield 300, and a variable winning unit 329 is disposed beneath variable display unit 307. Variable display unit 307 can variably display plural types of identification information formed of numerals, designs, symbols and so on. Variable winning unit 329 is set such that when pinballs fall into variable winning unit 329, a predetermined play value is supplied to the player. Variable winning unit 329 can alternate between a first state which is advantageous for the player and a second state which is disadvantageous for the player. If any of the pinballs flipped into playfield 300 by operation of shooting operation handle 320 falls into any of starting winning holes 331*a*, 331*b* and 331*c* being one example of a starting passage hole, then variable display unit 307 starts variation of the display. After a definite time period has elapsed, the varying display of variable display unit 307 is stopped. A winning hole is a ball receiving port which allows the ball flipped into the playfield to fall and enter into. The winning hole is set such that when the balls are received, a predetermined play value is supplied to the player and that the received balls may be guided to a rear face of playboard 306. A passage hole is a hole which allows the balls flipped into the playfield to fall and enter into. The passage hole is set such that a predetermined play value can be supplied to the player with entrance of the balls into the passage hole. The balls that have entered into the passage hole are divided into two types: the one is guided to the rear face of playboard 306, and the other passes through the hole and then discharged again into playfield 300. In other words, the "passage" is a broad concept including the concept of "winning". The starting winning hole is one type of winning holes, which is set to start the operation of variable display unit 307 (or variable winning unit 329 in some cases) as well as supply a predetermined play value to the player when the pinball flipped into the playfield falls into the starting winning hole.

If the result of the display provided when variable display unit 307 stops provides a predetermined specific combination of identification information (e.g., 777), an opening/closing plate 330 of variable winning unit 329 is opened, so that a state where a play value can be supplied to the player, i.e., a great winning state is generated. Normal winning holes 332 and 333 are further provided in playfield 300. When pinballs fall into normal winning hole 332, 333 or variable winning unit 329, a predetermined number of prize balls are dispensed through a prize ball dispensing outlet 316 into supply tray 315, so that a play value is supplied to the player. The prize ball is a pinball serving as the play value which is supplied to the player due such as to the winning of a flipped ball. If supply tray 315 is filled with prize balls and can no longer store any balls therein, surplus prize balls are dispensed through a surplus prize ball dispensing outlet 323 into a surplus prize ball receiving tray 322. A lost-ball port 334 serves to recover lost balls, which are the pinballs flipped into playfield 300 and having fallen down without falling into any winning holes or winning units. A mount member 319 serves to mount ball shooting unit 305 onto the front frame.

Referring to FIG. 18, ball shooting unit 305 operating responsive to the operation of shooting operation handle 320 (see FIG. 17) is provided at the lower part of pinball game machine 301. This ball shooting unit 305 is comprised of a ball shooting motor 351 being one example of an electric drive source, a drive vane 352 rotated by ball shooting motor 351, a lever 353 abutting against drive vane 352, a ball flipping hammer 354 unified with lever 353 and swung intermittently with rotation of drive vane 352, and a ganged ascending/descending unit 355 ascending/descending in gang with the intermittent swinging of ball flipping hammer 354. With ganged ascending/descending unit 355 ascending/descending, a ball supplying mechanism not shown is operated, so that the pinballs in supply tray 315 are supplied one by one to a ball shooting position. With drive vanes 352 being rotated by a driving force of motor 351, lever 353 is pressed down, so that hammer 354 unified with lever 353 turns in a counterclockwise direction in FIG. 18. Hammer 354 is biased in a clockwise direction in FIG. 18 by a spring. As soon as the abutment between drive vane 352 and lever 353 is released, lever 353 and hammer 354 turn in the clockwise direction in FIG. 18. Then, the pinballs provided at the above-described ball shooting position are flipped by a tip end of hammer 354 and shot into playfield 300 after having passed between an inner rail 353*a* and an outer rail 353*b* (see FIG. 17).

The pinball that have been shot by shooting unit 305 and then fallen into winning hole 332 are guided onto a winning ball collecting gutter 347 and then introduced into a winning ball processor 348. Winning ball processor 348 causes a prize ball dispenser 346 to operate for each winning ball, to dispense a predetermined number (e.g. 15) of prize balls. The winning balls that have passed through winning ball processor 348 are discharged outside the machine through a winning ball discharging passage 349. The prize balls in a prize ball storing tank 343 are supplied to prize ball dispenser 346. More specifically, the prize balls in prize ball storing tank 343 are arrayed in two rows by a ball arrangement gutter 344, and then supplied into prize ball dispenser 346 through a curving gutter 345.

Referring to FIG. 18, a winning ball collecting cover 338 serves to guide the pinballs that have fallen into winning hole 332 onto winning ball collecting gutter 347, and also guide the pinballs that have fallen into starting winning hole 331*a* onto winning ball collecting gutter 347 after these winning balls passed through a starting winning ball detecting switch 341*a*. The pinballs that have fallen into starting winning holes 331*b* and 331*c* are also detected by starting winning ball detecting switches 341*b* and 341*c* and then guided onto winning ball collecting gutter 347. In FIG. 18, a main body 340 of the variable display unit, a lost-ball port 334 and a solenoid 342 being one example of the electric drive source for opening/closing opening/closing plate 330 (see FIG. 17) of variable winning unit 329 are provided. A relay base plate 339 is also provided. A control base plate box 350 for game control serves to accommodate a game control base plate which controls the opening/closing of variable winning unit 329 and the display of variable display unit 307.

The ball shooting unit of the pinball game machine shown in FIG. 19 is disclosed in, for example, Japanese Patent Laying-Open No. 59-192381.

A shaft 313 penetrates a mount member 319. Shaft 313 and shooting operation handle 320 are engaged with each other at the front surface of mount member 319, while a fan-shaped gear 314A is attached to shaft 313 at the rear face of mount member 319.

A flipping force adjusting lever 312 is mounted on shooting operation handle 320. Flipping force adjusting lever 312 has a protrusion 312*a* on which the player's finger for turning lever 312 is hung. When the player holds this operation handle 320 by hand and hangs his or her finger on protrusion 312*a* of adjusting lever 312 to turn flipping force adjusting lever 312, shaft 313 is rotated, so that fan-shaped gear 314A is also rotated in the same direction. The motion of fan-shaped gear 314A is conveyed to a gear 314B and further to a gear 314C. This causes expansion of a wire 315 with its one end fixed onto gear 314C, so that a force is applied to hammer 354 which is attached to the other end of wire 315 by means of a spring 316. This causes adjustment of the pinball flipping force of hammer 354.

With fan-shaped gear 314A rotating as described above, an actuator 322 abutting against one end of gear 314A is driven, so that a microswitch 321 is turned on. With switch 321 turned on, motor 351 is activated, so that hammer 354 carries out a ball flipping operation.

As has been mentioned above, the conventional flipped ball game machine is structured such that balls are flipped into playfield 300 by the player's manipulation of shooting operation handle 320, and a play value is supplied to the player dependently on the trajectories of the falling flipped balls. Further, the conventional flipped ball game machine is structured such that the flipping force of the balls flipped into playfield 300 can be adjusted by the player's manipulation of shooting operation handle 320.

In the conventional flipped ball game machine represented by such a pinball game machine, the player can enjoy the falling state of the balls flipped into playfield 300; however, since the scores or evaluation of the game are dependent upon the player's skill of flipping balls, the player cannot simply enjoy chances as he or she does in slot machines, roulettes and the like.

SUMMARY OF THE INVENTION

A principal object of the present invention is therefore to provide a flipped ball game apparatus in which the player can enjoy chances under less influence caused by the player's skill of flipping balls as well as enjoy the falling state of the balls flipped into a playfield in the apparatus.

Another object of the present invention is to enable a flipping force of balls, automatically flipped into a playfield in a flipped ball game apparatus, to be adjusted to a desired flipping force without a flipping operation conducted by the player.

The present invention is directed to a flipped ball game apparatus having a playfield into which balls are shot. The flipped ball game apparatus includes: a ball shooting mechanism for shooting balls into the playfield; starting condition determining means for determining the satisfaction of game starting conditions which are satisfied with the minimal requirements that a valuable object having a predetermined value usable in a game is deposited into the apparatus; and shooting mechanism automatically controlling means responsive to a determination output of the starting condition determining means for controlling the driving of the ball shooting mechanism to automatically flip and shoot the balls. In the flipped ball game apparatus, the balls are automatically flipped and shot into the playfield on the basis of the satisfaction of the game starting conditions.

In the flipped ball game apparatus according to the present invention, if the game starting conditions are satisfied with the minimal requirements that a predetermined valuable object is deposited into the apparatus, then a determination output indicating the satisfaction of the game starting conditions is derived from the starting condition determining means. In response to the determination output from the starting condition determining means, the ball shooting mechanism is driven by action of the shooting mechanism automatically controlling means, so that the balls are automatically flipped and shot. That is, if the game starting conditions are satisfied, then the balls are automatically flipped and shot without the ball shooting operation conducted by the player.

More specifically, the ball shooting mechanism of the flipped ball game apparatus according to the present invention includes flipping force variably setting means for variably setting a flipping force of flipping and shooting the balls. The flipping force variably setting means includes an adjustment pick-up for changing and adjusting the flipping force by a manual operation, and flipping force fixing means for fixing the flipping force adjusted by the adjustment pick-up to avoid distortion thereof.

The starting condition determining means according to the present invention includes valuable object deposit determining means for determining that a valuable object having a predetermined value usable in a game is deposited in the apparatus, and starting operation determining means for determining that a predetermined operation for starting the game is conducted by the player.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 11A and 11B, 12 and 15 are flow charts for use in explaining the operation of the control circuit shown in FIG. 8;

FIG. 16 is a diagram showing information printed-out by a printer incorporated in the flipped ball game machine;

DESCRIPTION OF THE PREFERRED EMBODIMENTS

The embodiments of the present invention will now be described in detail with reference to the drawings.

Figure 1:
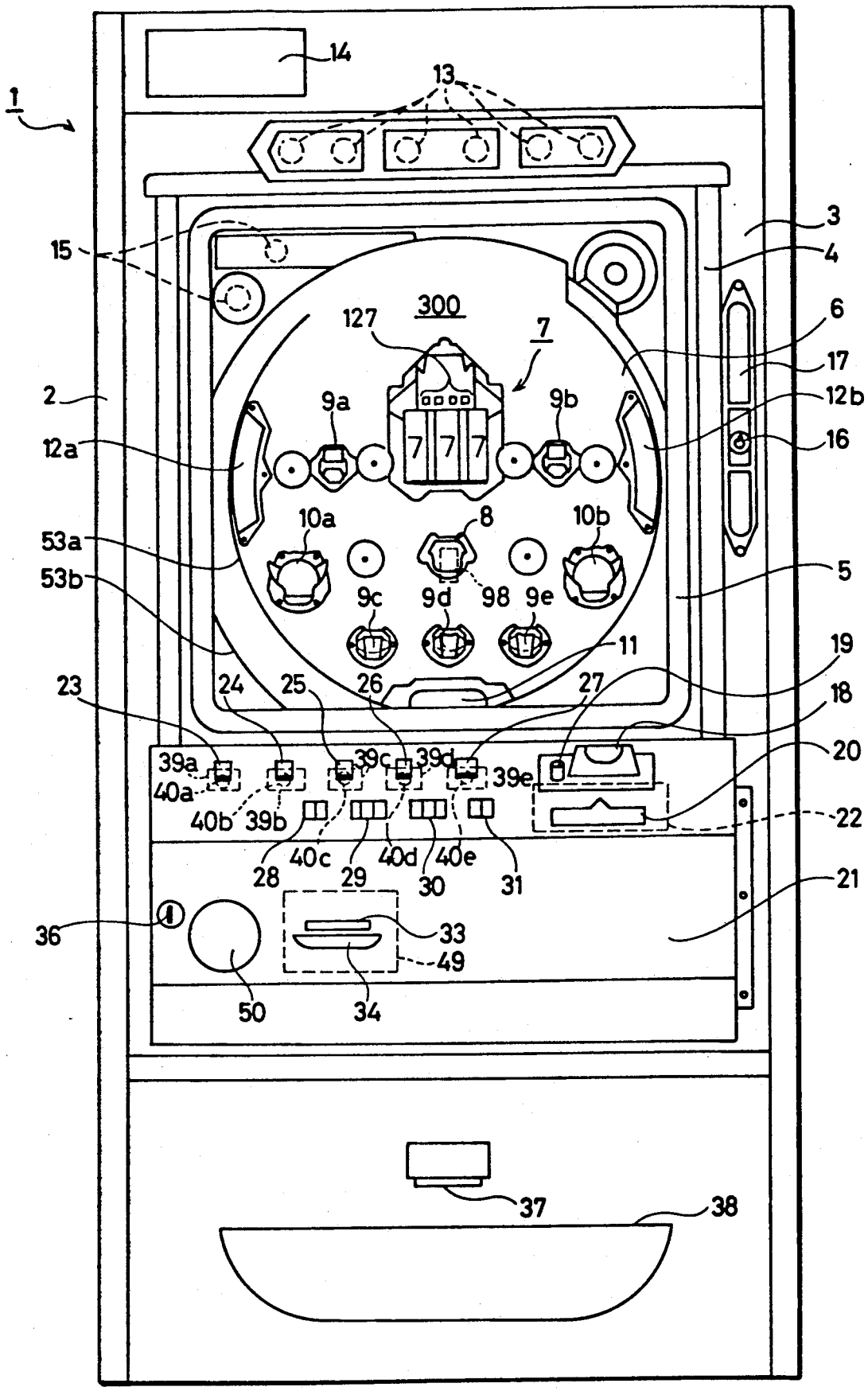
FIG. 1 is an overall front view showing one example of a flipped ball game machine according to the present invention.

FIG. 1 is an overall front view showing one example of a flipped ball game machine according to the present invention.

A front frame 3 that can be opened/closed is mounted on a main body 2 of a flipped ball game machine 1. A door supporting frame 4 is attached to this front frame 3. A glass door frame 5 and a front cover plate 21 that can be opened/closed are mounted relative to door supporting frame 4. Glass door frame 5 serves to support a glass plate covering a front surface of a playboard 6.

On front cover plate 21 are provided a coin deposit slot 18 into which a player deposits a coin or coins being one example of valuable objects, and a coin deposit indicator 20. With a power supply of flipped ball game machine 1 turned on, coin deposit indicator 20 is lighted on and off to indicate, e.g., "DEPOSIT COINS" and the like. The coins deposited through coin deposit slot 18 are detected by a deposited-coin detector 22. A coin return button 19 is provided in proximity to coin deposit slot 18. When the deposited coins are clogged in the course of passage, pressing this coin return button 19 causes the deposited coins to be returned through a coin dispensing outlet 37 onto a coin receiving tray 38. Also, a sound effect for coin deposit is issued from a loudspeaker 50 every time a coin is deposited through coin deposit slot 18.

On front cover plate 21 are provided a trouble button 23, a credit button 24, a one-coin bet button 25, a maximal coin number bet button 26 and a start button 27. Respective indicators **40*a*–40*e* are incorporated into respective switches 39*a*–39*e* which are turned on and off by those buttons 23–27. By pressing the respective buttons, lamps corresponding to the pressed buttons are turned on or off. More specifically, switches 39*a*–39*e*** are each formed of so-called illumination type switches.

When some trouble or jamming with balls takes place in the flipped ball game machine, the player presses trouble button 23. With trouble button 23 pressed, indicator 40*a* and a trouble indicator 14 are lighted on and off at the same time. A clerk working in a game house can discover the lighting on and off of trouble indicator 14 and recognize that some trouble occurs in flipped ball game machine 1.

If credit button 24 is pressed, a credit indicator 40*b* is lighted on, indicating that the player can play a credit game. The credit game is such a game that in place of depositing necessary coins for each game, the player deposits a number of coins in advance at a time and draws necessary coins for each game from the already deposited coins. As far as the deposited coins remain in the machine, the player can play the game repetitively without depositing new coins for each game. If credit button 24 is pressed again, the player can play a usual coin-operated game. This coin-operated game is such a game that a required number of coins are deposited through coin deposit slot 18 for each game.

In the credit game, pressing one-coin bet button 25 lights on a one-coin bet indicator 40*c*, enabling a one-coin bet game. In this one-coin bet game, the number of coins for use in one game is limited to one. A single coin is required for a one-game play, and a play value which is to be provided to the player in that game becomes a low play value corresponding to that single coin. If this one-coin bet button 25 is pressed twice, the player can play a two-coin bet game. In this two-coin bet game, the number of coins for use in one-game is limited to two. Two coins are required for a one-game play, and a play value which is to be provided to the player in that one game becomes a relatively high play value corresponding to the two deposited coins. Pressing maximal coin number bet button 26 lights on a maximal coin number bet indicator 40*d*, enabling a maximal bet game. In this maximal bet game, the number of coins for use in one game is limited to, for example, three. Three coins are required for a one-game play, and a play value which is to be provided to the player in that one game becomes a maximal play value corresponding to the three deposited coins.

If at least one coin is deposited through coin deposit slot 18, an indicator 40*e* for the start button is lighted on. On front cover plate 21 are further provided a flipped-ball number display 28, a dispensed-coin number display 29, a credit coin number display 30, a deposited-coin number display 31, a token dispensing unit 49, a token dispensing outlet 33 and a token receiving tray 34. This flipped-ball number display 28 displays the number of remaining balls to be flipped at a present time during the course of one game. More specifically, each time balls are flipped one by one, numbers which are subtracted by "1" from the original number "25" provided upon the start of one game, are displayed. When "00" is displayed, the one game is completed. Dispensed-coin number display 29 displays the number of coins that are dispensed to the player after the game is over. The number displayed by dispensed-coin number display 29 is added "1" by "1" every time coins are actually dispensed one by one from coin dispensing outlet 37 onto coin receiving tray 38. Credit coin number display 30 displays the number of remaining undrawn coins to be used out of the coins deposited during the credit game and the coins acquired by the game. Deposited-coin number display 31 displays the number of deposited coins in the coin-operated game or the number of drawn coins in the credit game.

On playboard 6 is provided a variable display unit 7 having three rotating drums. This variable display unit 7 variably displays plural types of identification information, the details of which will be described later. On playboard 6 are further provided various types of winning holes such as a starting passage winning hole 8, ordinary winning holes 9*a*–9*e* and tulip-shaped winning holes 10*a* and 10*b*. If balls flipped into a playfield 300 fall into any of those various types of winning holes, a winning sound effect is generated from loudspeaker 50, and also tokens are dispensed from token dispensing outlet 33 onto token receiving tray 34 by actuation of token dispensing unit 49. In place of the dispensing of tokens, such values may be displayed that a predetermined number of balls which can be flipped during one game are added and a predetermined number of remaining balls which are to be flipped and displayed by flipped-ball number display 28 are added.

If a ball falls into tulip-shaped winning hole 10*a* or 10*b*, a token is dispensed or a predetermined number of balls which can be flipped during one game are added, and also the tulip-shaped winning hole opens to left and right as shown in FIG. 1, facilitating the winning of the ball. If the ball falls into the winning hole again in this open position, the tulip-shaped hole returns to the original close position. If the ball falls into starting passage winning hole 8, this winning ball is detected by a detector 98 for detecting the ball falling into the starting passage winning hole, so that a variation of the display on variable display unit 7 is initiated as will be described later. This variable display unit 7 is comprised of three drums as will be described later. The drums are controlled to stop in the order of the left drum, the right drum and the middle drum when approximately four seconds have elapsed after the initiation of the variable display. A time interval between the stop of a preceding drum and the stop of a succeeding drum is, e.g., approximately one second. A drum rotating sound is issued from loudspeaker 50 while the drums are rotating. The falling of the ball into starting passage winning hole 8 is stored in a microcomputer 125 for drum control which will be described later. The storage of this winning is carried out up to four times at maximum, and a fifth winning and subsequent winnings are not stored but neglected. A storage value of the winning is displayed by a starting storage display 127. If the ball flipped into playfield 300 falls down without falling into any winning holes, this ball is recovered as a lost ball from a lost-ball outlet 11.

Referring to FIG. 1, a winning indicator designated by a reference numeral 15 lights up for e.g., 0.5 seconds every time a ball falls into any one of the various winning holes described above. Drum rotating indicators 12*a* and 12*b* are mounted on both the left and right sides of playfield 300. Drum rotating indicators 12*a* and 12*b* light up during the course of rotation of the drums of variable display unit 7 to indicate that the drums are rotating. Great-winning indicators 13 and 17 are mounted on front frame 3. On the basis of a specific combination (e.g., 777) of identification information provided when variable display unit 7 stops, great-winning indicators 13 and 17 are lighted on and off to indicate that a great winning is generated, and a great winning-dedicated sound effect is issued from loudspeaker 50. A clerk working in the game house discovers the great-winning display by great-winning indicator 13 and thus provides the player with a play value corresponding to the great win. The play value given to the player in accordance with this great win, is, for example, checks, money or expensive prizes. If the clerk presses a releasing switch (not shown) after providing the player with the play value, great-winning indicators 13 and 17 are lighted off. When the identification information provided upon the stop of variable display unit 7 forms a combination corresponding to an ordinary winning, a predetermined number of coins are dispensed through coin dispensing outlet 37, and also a coin dispensing sound is issued from loudspeaker 50.

Referring to FIG. 1, a key hole is designated by a reference numeral 16. Locking and unlocking operations of front frame 3 are enabled when the clerk in the game house inserts a key through this key hole 16. Another key hole is designated by a reference numeral 36. Locking and unlocking operations of front cover plate 21 are enabled when the clerk inserts a key through this key hole 36.

In the flipped ball game machine described in this embodiment, while a game play is initiated by pressing of start button 27, the game play may be started by pressing of maximal coin number bet button 26 without waiting for the pressing of start button 27. In addition, a separate cancel button for canceling a bet number set by the pressing of one-coin bet button 25 or maximal coin number bet button 26 may be provided to cancel the bet number already set. In this case, remaining deposited coins that have been canceled may be returned.

Figure 2:
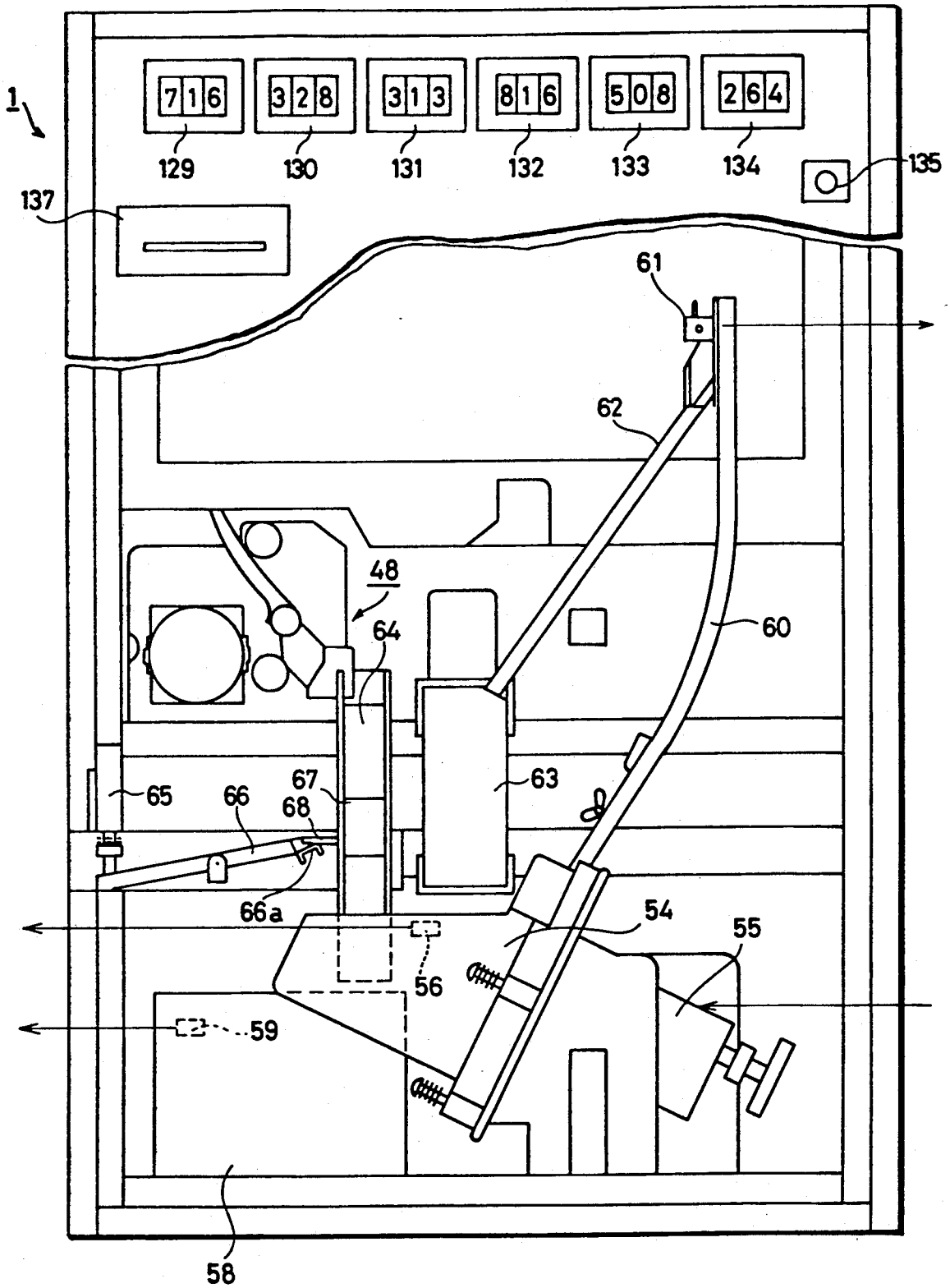
FIG. 2 is an overall rear view showing an internal structure of part of the flipped ball game machine.

FIG. 2 is a rear view showing an internal structure of a part of the flipped ball game machine.

Coins deposited through coin deposit slot 18 shown in FIG. 1 are guided through a deposited-coin passage 64 and then stored in a coin hopper 54. A coin full-up detector 56 is mounted on coin hopper 54. This coin hopper 54 serves to temporarily store the coins to be dispensed for the player. If the coins fill up coin hopper 54 and a detection signal is derived from coin full-up detector 56, then a passage changing solenoid 65 is excited in response to the derived detection signal. Accordingly, a coupling member 66 turns in an indicated clockwise direction, so that an abutting end 66*a* is detached from an engagement pin 68, whereby engagement pin 68 is lowered by its self weight. The lowering of engagement pin 68 causes a passage changing value 67 to change the passage, thereby allowing the coins passing through deposited-coin passage 64 to fall down on the side of an overflow coin tank 58. A coin full-up detector 59 is mounted on this overflow coin tank 58. If overflow coin tank 58 is filled with coins and a detection signal is derived from coin full-up detector 59, then a coin drawing instruction is displayed or reported to the clerk in the game house, so that the clerk recovers the coins filling overflow coin tank 58. The overflow coins may be directly discharged outside the machine in place of being stored in overflow coin tank 58.

The coins being stored in coin hopper 54 are lifted by a coin lift 60 by utilizing a driving force of a hopper motor 55 and then guided through a coin dispensing shoot 62 into a coin dispensing communication passage 63. This coin dispensing communication passage 63 is in communication with coin dispensing outlet 37 (see FIG. 1). The coins guided into coin dispensing communication passage 63 are dispensed through coin dispensing outlet 37 to the player. Referring to FIG. 2, a dispensed-coin detector designated by a reference numeral 61 serves to detect the number of coins to be dispensed. A detection output thereof is used for a control which will be described later.

In an upper portion of the flipped ball game machine are provided a deposited-coin number display 129 for displaying the number of deposited coins, a total dispensed-coin number display 130 for displaying the total number of coins dispensed to the player, a game number display 131 for displaying the number of games played by the player, a total drum rotation number display 132 for displaying the total number of variable displays on the variable display unit on the basis of the falling of balls into the starting passage winning hole, a dispensed-token number display 133 for displaying the number of tokens dispensed to the player, and a recovered-coin number display 134 for displaying the number of coins recovered into the flipped ball game machine. A printer 137 and a select switch 135 are further provided in the upper portion of flipped ball game machine 1. With select switch 135 pressed, desired game machine data is selected dependently on the number of pressing the select switch, so that the selected game machine data is printed out from printer 137. The game machine data that can be selected by select switch 135 are of seven types shown in FIG. 16 which will be described later. The game machine data selected by select switch 135 may be displayed by flipped-ball number display 28 and dispensed-coin number display 29 (see FIG. 1) without provision of printer 137. In addition, the game machine data selected also by flipped-ball number display 28 and dispensed-coin number display 29 may be displayed as well as printed out by printer 137.

Figure 3:
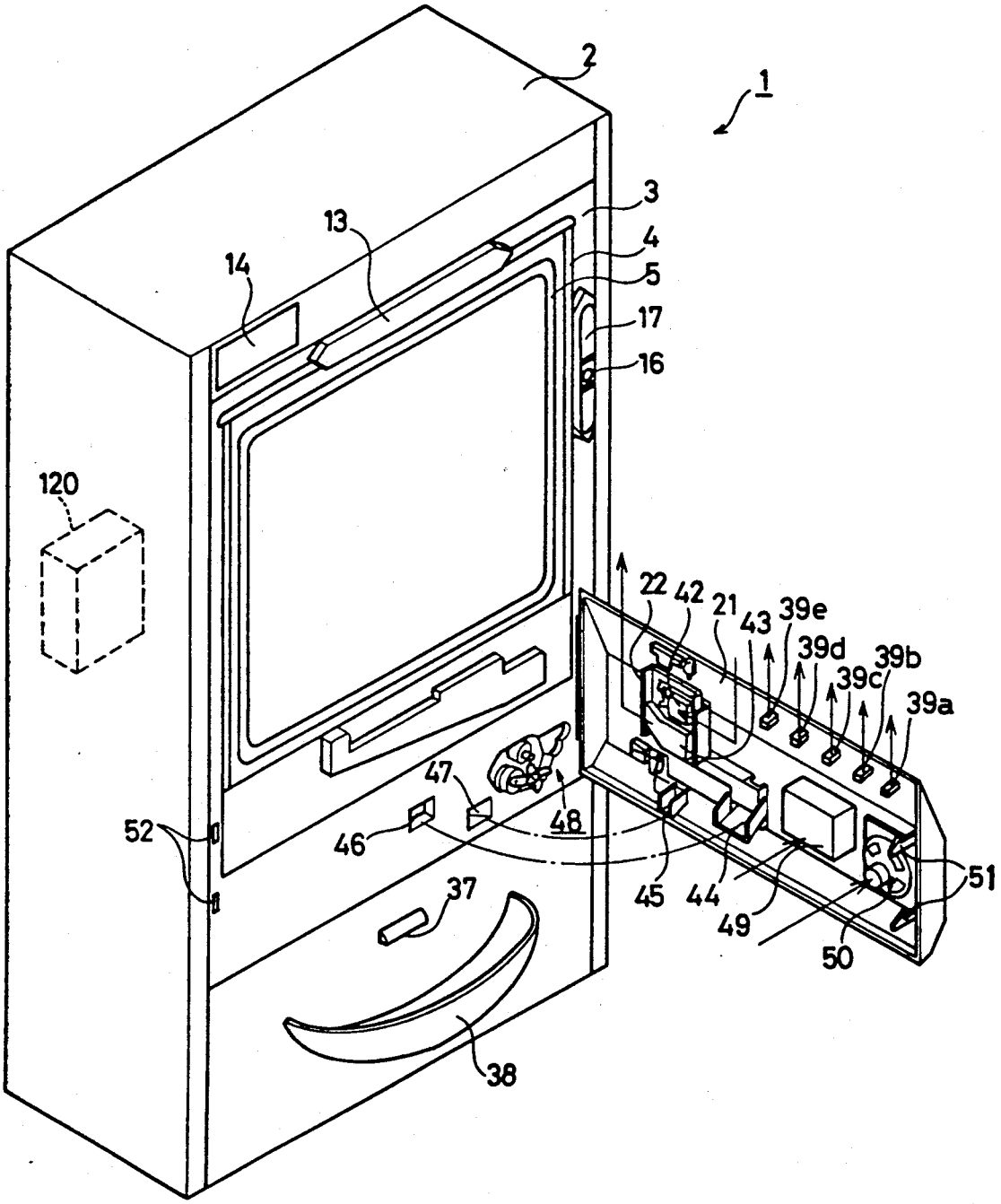
FIG. 3 is a perspective view of the flipped ball game machine in the state where a front cover plate is opened.

FIG. 3 is a perspective view showing the flipped ball game machine having its front cover plate open.

A pair of upper and lower engagement locking pieces 51 are mounted on front cover plate 21 of flipped ball game machine 1. Normally, these engagement locking pieces 51 are engaged with engagement holes 52 formed in front frame 3, and front cover plate 21 is locked in a close position. When the clerk in the game house inserts a key through key hole 36 (see FIG. 1), the pair of upper and lower engagement locking pieces 51 move downward, thereby releasing the engagement between the engagement locking pieces 51 and engagement holes 52 and thus allowing front cover plate 21 to be opened. A deposited-coin detector 22 for detecting coins deposited through coin deposit slot 18 (see FIG. 1) is mounted on a rear surface of front cover plate 21. A coin deposit preventing solenoid 42 for preventing coins from being deposited into the game machine is mounted on deposited-coin detector 22. In the case of a coin-operated game play, since a maximal bet number is three, i.e., three coins as has been previously mentioned, maximal three coins are permitted to be deposited into coin deposit slot 18. The maximal three deposited coins are delivered from a normal coin outlet 45 into a normal coin receiving port 47 and then guided into deposited-coin passage 64 (see FIG. 2). As to a fourth and subsequent deposited coins, since a deposited-coin guiding path is changed with excitation of coin deposit preventing solenoid 42, the coins are delivered from a returned-coin outlet 44 into a returned-coin receiving port 46, then guided through coin dispensing communication passage 63 to coin dispensing outlet 37 and returned onto coin receiving tray 38. In the case of a credit game, maximal 300 deposited coins are guided to normal coin outlet 45, whereas subsequent deposited coins of the three-hundredth coin are guided to the returned-coin outlet as in the foregoing description. Referring to FIG. 3, a coin identifier designated by a reference numeral 43 serves to determine whether a deposited coin is a normal coin or an abnormal coin. The coin determined as a normal coin is guided to normal coin outlet 45, whereas the one determined as an abnormal coin is guided to returned-coin outlet 44. In addition, when a game is started, coin deposit preventing solenoid 42 is excited, so that the coin deposited during the game is guided to returned-coin outlet 44. When one game is over, the excitation of coin deposit preventing solenoid 42 is released, so that the deposited coin is guided again to normal coin outlet 45. On the rear surface of front cover plate 21 are further provided loud speaker 50, token dispensing unit 49, detector 39*a* for a trouble button, a detector 39*b* for a credit button, a detector 39*c* for a one-coin bet button, a detector 39*d* for a maximal coin number bet button and a detector 39*e* for a start button. Referring to FIG. 3, a reference numeral 2 designates the main body of the game machine; 13, 17, the great-winning indicators; 14, the trouble display; 4, the door supporting frame; 5, the glass door frame; and 16, the key hole. Further, a microcomputer 120 for a game control is provided in main body 2 of the game machine.

Figure 4:
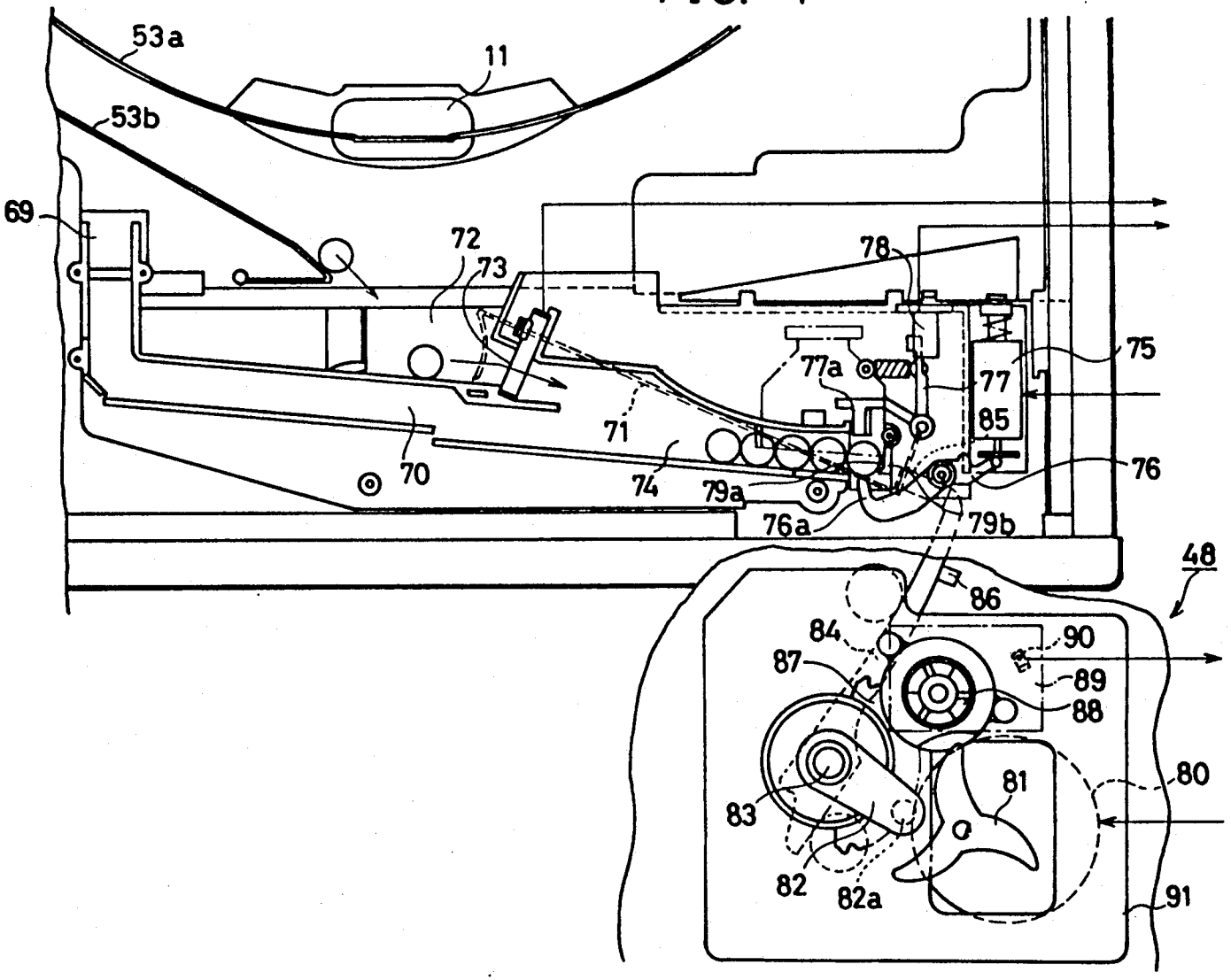
FIG. 4 is a structural view for use in explaining the structure and the operation of a ball shooting mechanism.

FIG. 4 is a structural view for use in explaining a ball shooting mechanism.

A ball shooting unit 48 mainly comprises a ball flipping lever or hammer 84, a ball shooting motor 80, a rotation cam 81, a flipping force setting portion 88, a flipping force fixing plate 89, and a mounting base plate 91 on which these units and members are mounted. If game starting conditions are satisfied, shooting motor 80 is driven, so that rotation cam 81 rotates. With rotation of rotation cam 81, the rotation cam forces a pin 82*a* down while abutting against the pin. With pin 82*a* forced down, a working plate 82 is turned in an indicated clockwise direction around a ball flipping hammer axis 83. Working plate 82 and flipping hammer 84 are unified such that hammer 84 turns in the same direction as the turning of working plate 82. When hammer 84 turns in the indicated clockwise direction, the light projected by a ball flipping hammer timing detector 90 of a light projecting/receiving type is intercepted by an intercepting plate 86, so that a detection signal is derived from hammer timing detector 90. A shot-ball feeding solenoid 75 is excited in response to the detection signal derived from hammer timing detector 90. With excitation of solenoid 75, a swing member 76 for ball feeding is turned in the indicated clockwise direction, so that a ball in a ball supply passage 74 is delivered to a predetermined ball shooting position on a ball shooting rail 71 by a protruding portion 76*a* for ball feeding. A ball contact portion 77*a* serves to make contact with the ball delivered by protruding portion 76*a*. If ball contact portion 77*a* makes contact with the delivered ball, a ball delivery detecting lever 77 swings, the swing being detected by a ball delivery detector 78.

The ball supplied to the predetermined shooting position on shooting rail 71 is flipped by a hammer tip 85 of swinging hammer 84, then passes on shooting rail 71 and between ball guiding rails 53*a* and 53*b* and enters into playfield 300. On the other hand, a ball that has not reached playfield 300 due to an insufficient flipping force rolls down in a reverse direction between guiding rails 53*a* and 53*b*. The ball is then recovered as a foul ball into a foul ball port 72 and again restored onto ball supply passage 74. A foul ball detector 73 for detecting this foul ball is provided. The ball flipped into playfield 300 enters into any one of the various winning holes or lost-ball port 11 and is then restored from a stored-ball circulating communication port 69 through a stored-ball passage 70 onto ball supply passage 74 again. More specifically, if the ball in ball supply passage 74 is shot and flipped, then the shot ball circulates within the flipped ball game machine and restored again into ball supply passage 74. Referring to FIG. 4, ball stopping walls designated by reference numerals 79*a* and 79*b* serve to stop the balls that have rolled down along ball supply passage 74.

When the clerk in the game house operates flipping force setting portion 88 mounted in ball shooting unit 48 to make a turning operation, a flipping force adjusting gear 87 is turned, so that deformation of a spring (not shown) for providing a flipping force to hammer 84 is adjusted. Since this adjustment of the spring deformation changes a restoring force of the spring, a flipping force applied by hammer 84 is changed to be adjusted. The amount of adjustment of the changed flipping force is fixed or determined by flipping force fixing plate 89 so that no distortion may be produced in the changed flipping force.

Figure 5B:
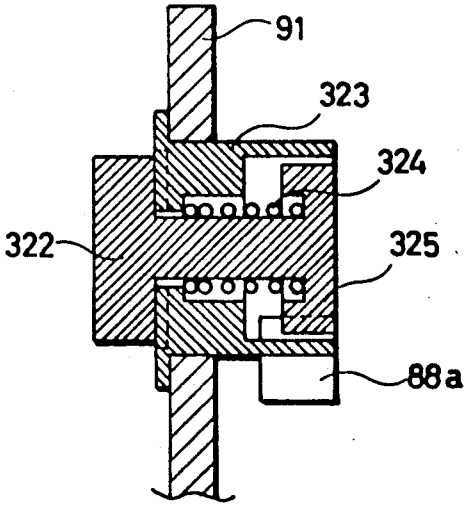
FIGS. 5A and 5B are diagrams for use in explaining action of a mechanism for adjusting a flipping force.
Figure 5A:
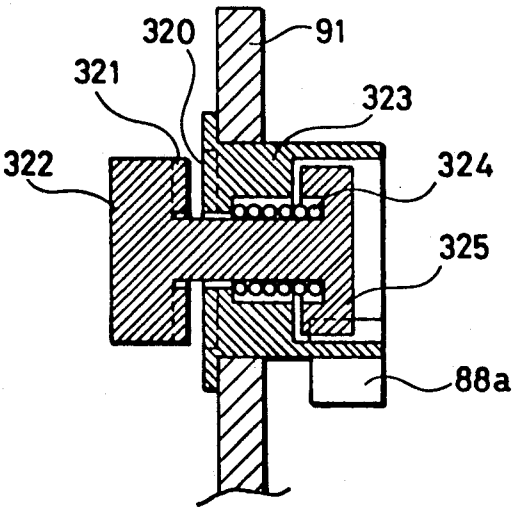

FIGS. 5A and 5B are action views for use in explaining an adjustment method of a flipping force.

Figure 6:
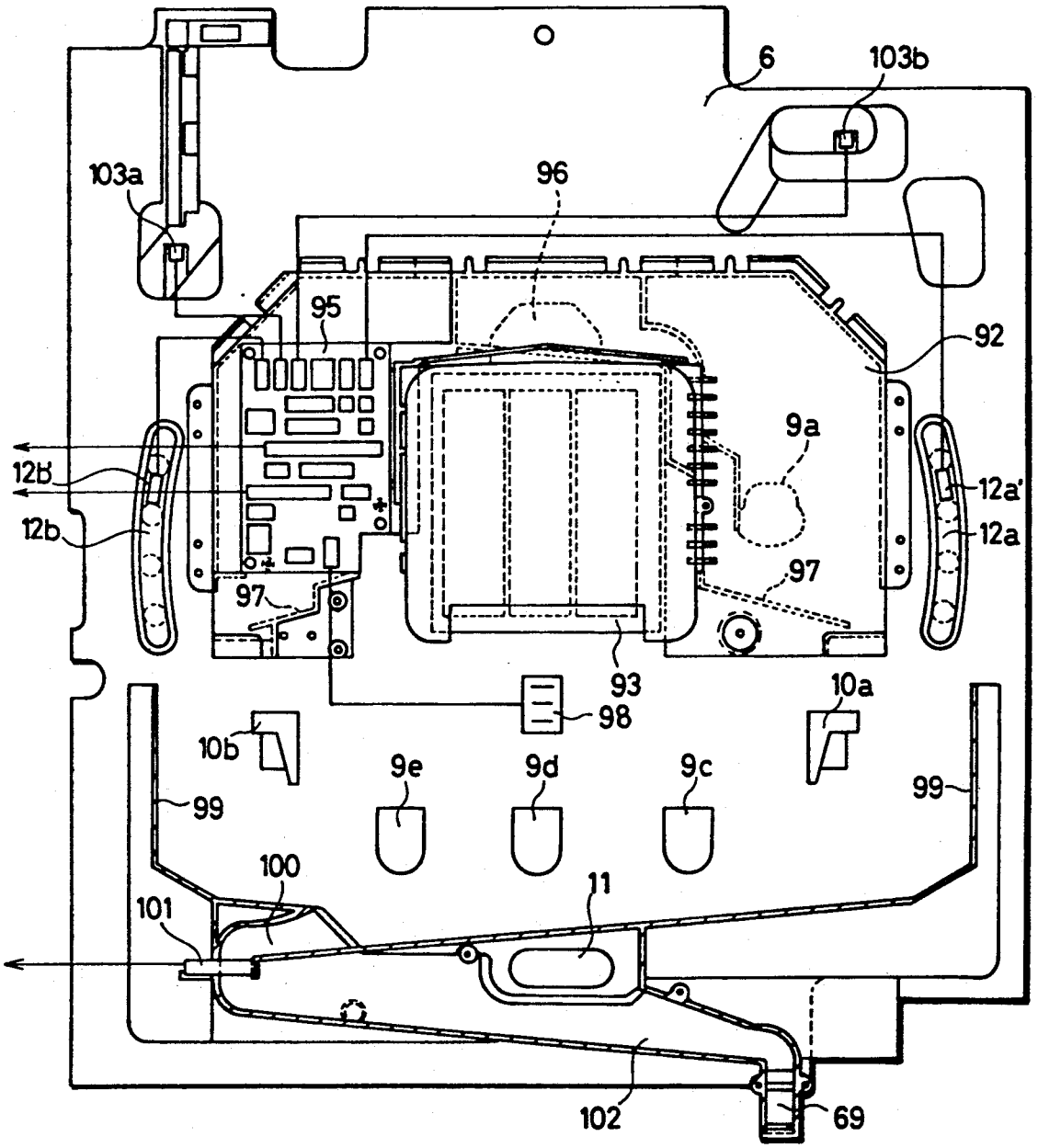
FIG. 6 is a rear view showing various devices mounted on a rear face of a playboard.

FIG. 5A illustrates a mechanism under an adjustment operation; and FIG. 5B illustrates a normal state of the mechanism under no adjustment operation. A housing 323 is incorporated in a notch of mounting base plate 91. An adjustment pick-up 322 and a gear 325 integrally formed with the adjustment pick-up are incorporated in housing 323. Referring to FIG. 5A, an actuating spring is designated by a reference numeral 324. Adjustment pick-up 322 is actuated in an indicated right direction by a restoring force of actuating spring 324. In the normal state, as shown in FIG. 5B, engagement teeth 321 of adjustment pick-up 322 and engagement teeth 320 of housing 323 mesh with each other, so that adjustment pick-up 322 cannot turn. In the case of adjusting a flipping force, the clerk in the game house releases the engagement between both engagement teeth 321 and 320, to turn adjustment pick-up 322, as shown in FIG. 5A. When adjustment pick-up 322 turns, gear 325 also turns integrally with adjustment pick-up 322, thereby to turn a gear 88*a* being in mesh with engagement teeth formed in outer peripheries of gear 325. Gear 88*a* is in mesh with flipping force adjusting gear 87 shown in FIG. 4. With rotation of gear 88*a*, flipping force adjusting gear 87 is turned, so that the flipping force is adjusted as mentioned above. When the flipping force adjustment is completed, both engagement teeth 320 and 321 are meshed with each other by actuating spring 324, thereby to interrupt the turning of gear 325 and thus fix the amount of adjustment of the flipping force. While such a flipped ball game machine that the flipping force is adjustable in the game house has been described in this embodiment, the present invention is not limited to this. For example, such a flipped ball game machine may be applied that a flipping force is adjusted and fixed at the stage of manufacture of the machine by manufacturers and no adjustment of the flipping force can be made after shipment of the machine. Alternatively, a flipped ball game machine may be applied that a flipping force can be selected and set by the player who manipulates a newly provided flipping force selecting button before a game is started. FIG. 6 is a rear view showing various units mounted on a rear surface of the playboard.

A winning ball collecting cover 92 is mounted on the rear surface of playboard 6. Winning balls that have fallen into ordinary winning holes 96, 9a and 9b (9b is not shown) are introduced to a predetermined place by a winning ball guiding gutter 97 mounted on winning ball collecting cover 92 and are then guided onto a winning ball collecting gutter 99. Winning balls that have fallen into tulip-shaped winning holes 10a and 10b or ordinary winning holes 9c-9e are also introduced onto winning ball collecting gutter 99. The winning balls guided onto winning ball collecting gutter 99 are assembled into a winning ball collecting portion 100 and then detected by a winning ball detector 101. After that, the winning balls are introduced to stored-ball circulating communication port 69 through a ball return passage 102. A lost ball that has fallen into lost-ball port 11 is also introduced to stored-ball circulating communication port 69 through ball return passage 102. The balls introduced to stored-ball circulating communication port 69 are again restored to ball supply passage 74 (see FIG. 4) as mentioned above.

A notch is formed about the center of winning ball collecting cover 92, in which notch a rotating drum mechanism 93 is positioned. A rear surface of rotating drum mechanism 93 is covered with a drum cover 94. A relay terminal plate 95 is mounted on winning ball collecting cover 92. Relay terminal plate 95 is connected with lamp relay terminals 103a and 103b mounted on the rear surface of playboard 6, lamp relay terminals 12a, and 12b, of drum rotating indicators 12a and 12b mounted on the playboard, detector 98 for detecting balls falling into the starting passage winning hole, and the like. Relay terminal plate 95 serves to relay the connection between electric devices associated with a game control and a microcomputer for control.

Figure 7:
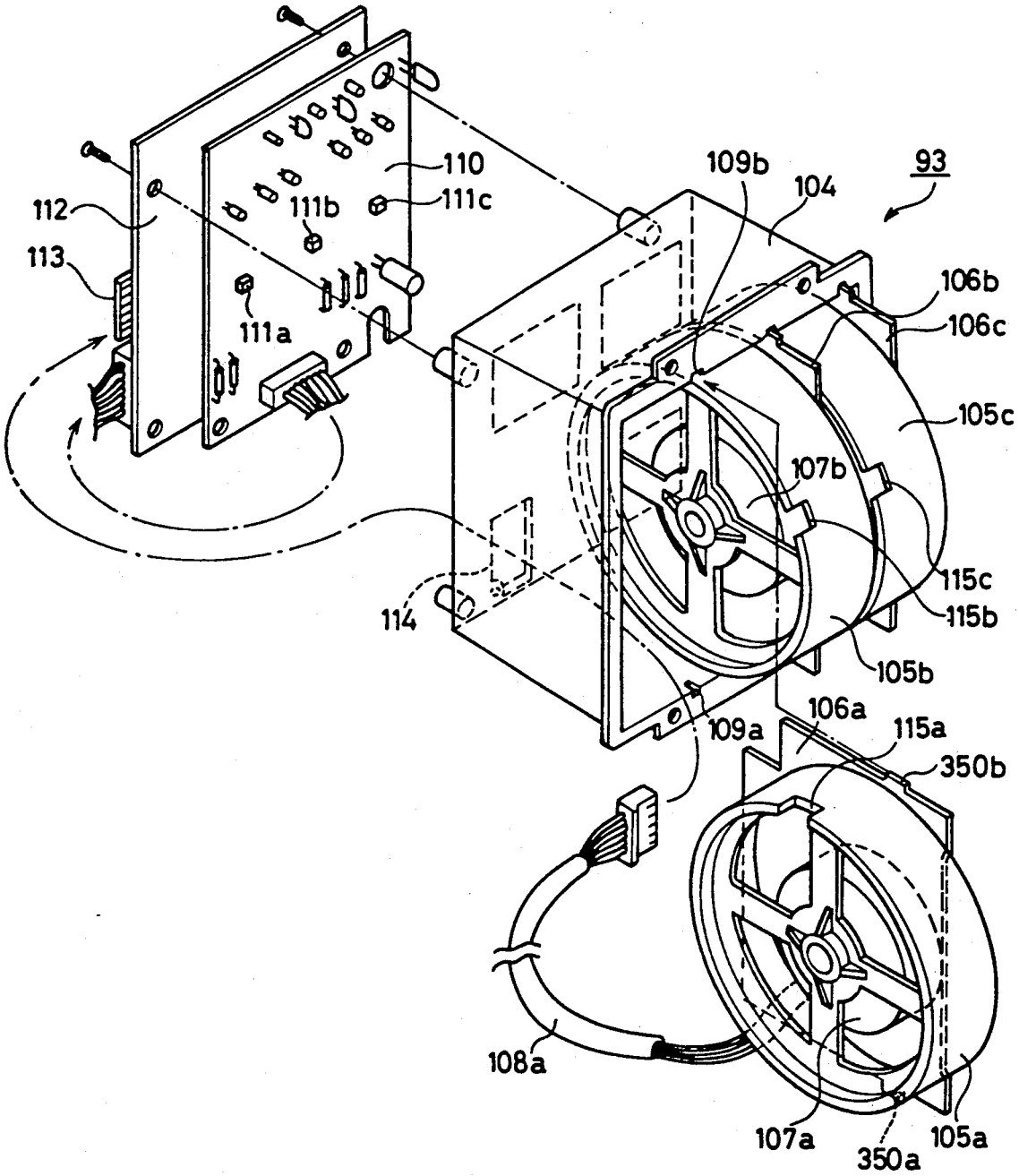
FIG. 7 is an exploded perspective view for use in explaining the structure of a rotating drum mechanism.

FIG. 7 is an exploded perspective view for use in explaining the structure of rotating drum mechanism 93.

A plurality of rotating drums 105a-105c (three rotating drums are shown in FIG. 7) are incorporated onto a main casing 104 of rotating drum mechanism 93. Positioning guides 109a and 109b for attaching rotating drums 105a-105c are formed in main casing 104. Rotation motors 107a, 107b and 107c comprised of stepping motors or the like are attached respectively to drum attaching plates 106a, 106b and 106c for attaching respective drums 105a, 105b and 105c. Respective rotating drums 105a, 105b and 105c are attached to respective rotation motors 107a, 107b and 107c. Respective rotating drums 105a-105c are rotated by a driving force of respective rotation motors 107a-107c. Positioning protrusions 350a and 350b are formed in drum attaching plates 106a-106c. Positioning protrusions 350a and 350b are inserted into positioning guides 109a and 109b formed in main casing 104 and held therein for positioning. Connection wires designated by 108a-108c (108b and 108c are not shown) serve to supply currents for driving rotation motors 107a-107c. Connection wires 108a-108c are connected to a connection terminal 113 mounted on a relay terminal base plate 112. A notched hole 114 is formed in main casing 104, through which connection wire 108a can be connected to connection terminal 113. Relay terminal base plate 112 is attached to main casing 104. With relay terminal base plate 112 attached to main casing 104, a drum position detecting base plate 110 is mounted to be interposed between main casing 104 and relay terminal base plate 112. Position detectors 111a, 111b and 111c are mounted on drum position detecting base plate 110. Rotary position-detected portions 115a-115c formed respectively in rotating drums 105a-105c are detected by position detectors 111a-111c, respectively. Designs and numerals being one example of plural types (e.g., 16 types) of identification information are drawn on outer peripheries of respective rotating drums 105a-105c. Determination on combinations of the identification information displayed by stopped rotating drums 105a-105c is enabled by determination on the number of feeding steps of rotation motors 107a-107c, the number obtained after position detectors 111a-111c detect stop position-detected portions 115a-115c when respective rotating drums 105a-105c stop.

If the identification information of respective rotating drums 105a-105c form a specific combination of the identification information (e.g., "777"), a great winning is generated. If the identification information displayed when respective rotating drums 105a-105c stop is displayed such as "SANKYO SANKYO SANKYO", an ordinary winning is provided which supplies a lower value to the player as compared to the great winning. In this case, coins are dispensed to the player. While the variable display unit having three rotating drums has been shown in this embodiment, the present invention is not limited to this. Such a variable display unit having one or two rotating drums or the one having four or more rotating drums may be employed. Further, a display unit of a digital display type using a liquid crystal or the like in place of a rotating drum may be employed. In addition, a display unit of a leaf-type or electroluminescence type may be employed. Further, a so-called roulette-type variable display unit, which includes a plurality of lamps or LEDs to make a variable display while circulating the lamps and LEDs to make a traveling lighting-up, may be employed. Also, a so-called rotating disk type variable display unit which makes a variable display by using a plurality of rotating disks may be employed. Further, combinations of at least two types of the above-described variable display units such as the combination of the drum-type and the digital-type display units may be employed. Also, a belt type variable display unit or a dot-matrix type variable display unit may be employed. While such a variable display unit that starts a variable display when a game is started or when a ball falls into the starting passage winning hole has been illustrated in this embodiment, this variable display unit may be replaced by a variable display unit which normally makes a variable display and restarts the variable display when a game is started or when a ball falls into the starting passage winning hole. In this case, it is desirable to inform that the variable display is restarted by changing the brightness or the speed of the variable display. Further, a stop button for stopping this variable display unit may be provided to stop the variable display unit when a predetermined time period has elapsed without the stop button operated or when the stop button is operated before the predetermined time period has elapsed.

Figure 8:
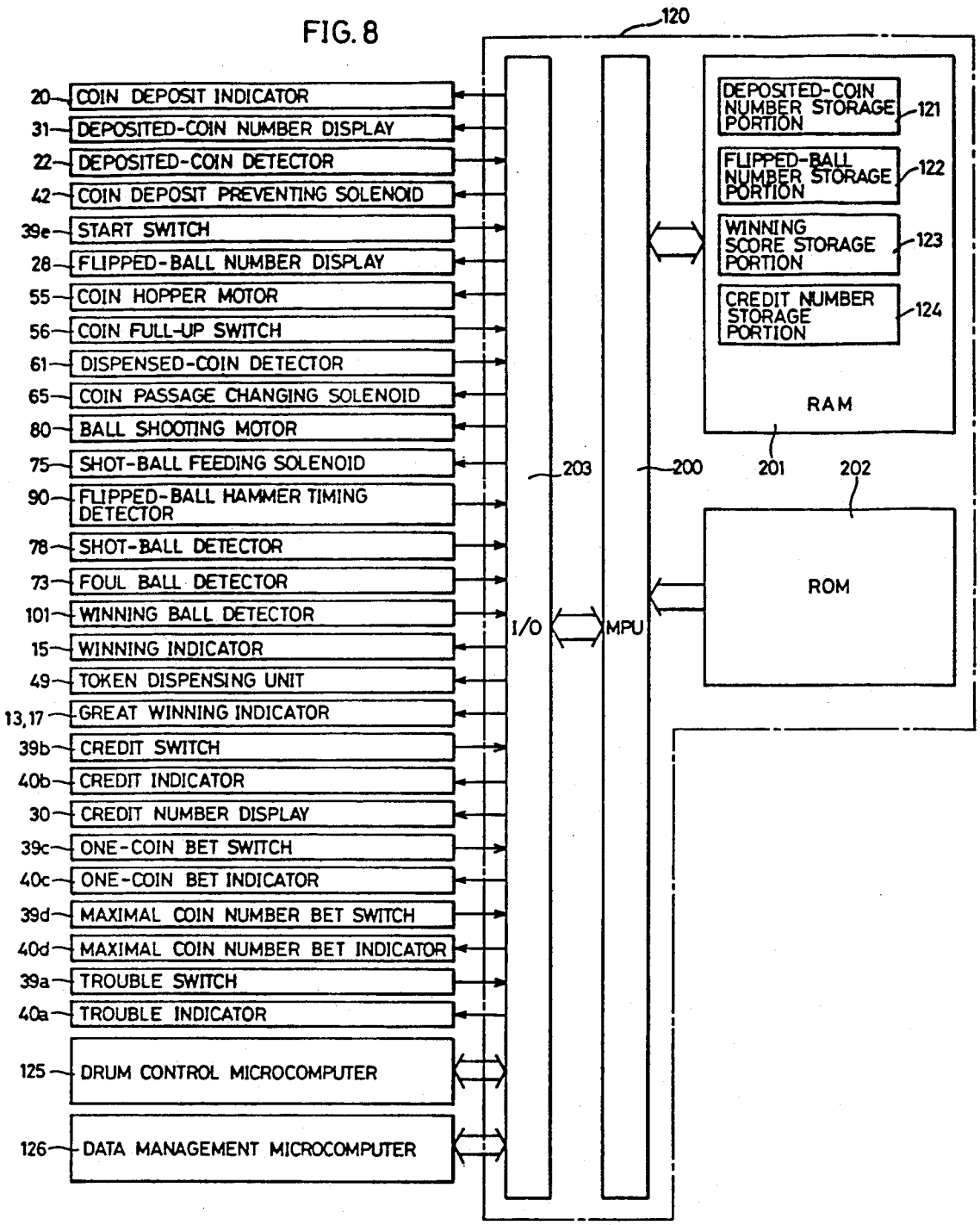
FIG. 8 is a block diagram showing a microcomputer for control of a pinball game, and a control circuit including various devices connected to the microcomputer.

FIG. 8 is a block diagram illustrating microcomputer 120 for control of a pinball game and a control circuit comprised of various apparatuses connected thereto.

Game control microcomputer 120 has a function of controlling the operation of the following various types of apparatuses. Thus, microcomputer 120 is formed of, e.g., an LSI of several chips. Microcomputer 120 includes an MPU 200 capable of executing a control operation in a predetermined procedure, an ROM 202 for storing operation program data of MPU 200 therein, and an RAM 201 capable of writing and reading principal data.

Microcomputer 120 further includes an input/output circuit (I/O) 203 for applying input data to MPU 200 in response to an input signal and also outputting output data received from MPU 200, a power-on reset circuit (not shown) for applying reset pulses to MPU 200 when a power supply is turned on, a clock generating circuit (not shown) for applying a clock signal to MPU 200, a pulse frequency-demultiplying circuit (not shown) for frequency-demultiplying the clock signal from the clock generating circuit to regularly apply interruption pulses to MPU 200, an address decoding circuit (not shown) for decoding address data from MPU 200.

MPU 200 can execute an operation of an interruption control routine in response to the interruption pulses regularly applied from the pulse frequency-demultiplying circuit. The address decoding circuit decodes the address data from MPU 200 to apply chip-select signals to ROM 202, RAM 201 and I/O circuit 203, respectively.

In this embodiment, as ROM 202, a programmable ROM, in which program data stored therein for MPU 200 can be altered when the contents thereof is rewritten or if necessary, is employed. RAM 201 includes a deposited-coin number storage portion (a bet number counter) 121 for storing the number of deposited coins therein, a remaining ball number storage portion (a ball number counter) 122 for storing the number of remaining balls in one game, a winning score storage portion 123 for storing scores based on the winning of balls, and a credit number storage portion (a credit counter) 124 for storing a credit number, i.e., the number of deposited coins in a credit game. A token dispensing method in which a token having a value of one point, for example, is dispensed to the player every time a single ball wins may be replaced by e.g., a method in which after one game is over with 25 balls flipped, a score (e.g., 5 points) corresponding to the number of winning balls (e.g., 5 balls) during the one game is written in a single token and the written token is then dispensed to the player. MPU 200 applies control signals to the various types of apparatuses in response to the program data stored in ROM 202 and to outputs of the following respective control signals.

First, a control signal for coin deposit indication is applied to coin deposit indicator 20 (see FIG. 1). A control signal for displaying the number of deposited coins is applied to deposited-coin number display 31 (see FIG. 1). If coins are deposited in coin deposit slot 18 (see FIG. 1), then the deposited coins are detected by deposited-coin detector 22, so that a detection signal thereof is applied to game control microcomputer 120. When the deposition of the coins into the machine must be prevented, a control signal for solenoid excitation is applied to coin deposit preventing solenoid 42 (see FIG. 3), thereby changing the path of the deposited coins. If the player presses start button 27 (see FIG. 1), then a start switch **39*e* is turned on, so that a starting operation signal thereof is applied to game control microcomputer 120. A control signal for displaying the number of flipped balls in one game is applied to flipped-ball number display 28. A control signal for coin hopper motor driving is applied to a coin hopper motor 55. If the coins fill up coin hopper 54 (see FIG. 2), then a coin full-up switch 56 is turned on, so that a coin full-up detecting signal is applied to game control microcomputer 120. The coins which are lifted by coin lift 60 (see FIG. 2) and dispensed to the player are detected by dispensed-coin detector 61, so that a detection signal thereof is applied to microcomputer 120. If the coins fill up coin hopper 54 (see FIG. 2), then a signal for solenoid excitation is applied to coin passage changing solenoid 65 so as to preserve the deposited coins in overflow coin tank 58 (see FIG. 2). A motor driving control signal for driving ball shooting motor 80 (see FIG. 4) is applied to ball shooting motor 80. The driving of the shooting motor causes flipping hammer 84 to swing. If the light projected by hammer timing detector 90 is intercepted by intercepting plate 86, then hammer timing detector 90 is turned on, so that a timing detection signal thereof is applied to microcomputer 120. In response to the detection signal of hammer timing detector 90, a control signal for exciting shot ball feeding solenoid 75 is applied to solenoid 75. The excitation of solenoid 75 causes the shot balls to be fed to a ball shooting position. The fed shot-balls are detected by shot-ball detector 78 (see FIG. 4), so that a detection signal thereof is applied to microcomputer 120. If the balls become foul balls and are detected by foul ball detector 73 (see FIG. 4), then a detection signal thereof is applied to microcomputer 120. If the ball flipped into playfield 300 falls into any one of the winning holes, the winning ball is detected by winning ball detector 101 (see FIG. 6), so that a detection signal thereof is applied to microcomputer 120. A control signal for indicating the winning of the ball is applied to winning indicator 15 (see FIG. 1). A control signal for dispensing a token with the winning of the ball is applied to token dispensing unit 49. If the result of display provided when the variable display unit stops forms a predetermined specific combination (e.g., "777"), then a control signal for indicating a great winning is applied to great-winning indicators 13 and 17. With credit button 24 (see FIG. 1) pressed, credit switch 39*b* is turned on, so that a credit detection signal thereof is applied to microcomputer 120. In response to this credit detection signal, an indication control signal for indicating a credit game is applied to credit indicator 40*b*. A control signal for displaying a credit number, i.e., the number of remaining deposited coins during the credit game is applied to credit number display 30. With one-coin bet button 25 (see FIG. 1) pressed, a one-coin bet switch 39*c* is turned on, so that a signal for detecting the one-coin bet operation is applied to microcomputer 120. In response to the applied detection signal, a control signal for indicating the betting of one coin is applied to one-coin bet indicator 40*c*. If maximal bet button 26 (see FIG. 1) is pressed, then maximal bet switch 39*d* is turned on, so that a signal for detecting the maximal bet operation is applied to microcomputer 120. In response to the maximal bet operation detecting signal, a control signal for indicating a maximal bet game is applied to maximal bet 20 indicator 40*d*. If trouble button 23 (see FIG. 1) is pressed, then trouble switch 39*a* is turned on, so that a signal for detecting the trouble operation is applied to microcomputer 120. In response to the trouble operation detecting signal, a control signal for indicating that trouble occurs is applied to trouble indicator 40*a*. Transmission of control signals is carried out between drum control microcomputer 125 for controlling rotating drum mechanism 93 (see FIG. 7) of the variable display unit and game control microcomputer 120. Transmission of data is carried out between a data management microcomputer 126 for managing data such as the number of games or the total amount of wins after a power supply is turned on and game control microcomputer 120**. A predetermined direct current is supplied from a power supply circuit (not shown) to each of the various apparatuses and the game control microcomputer.

Figure 9:
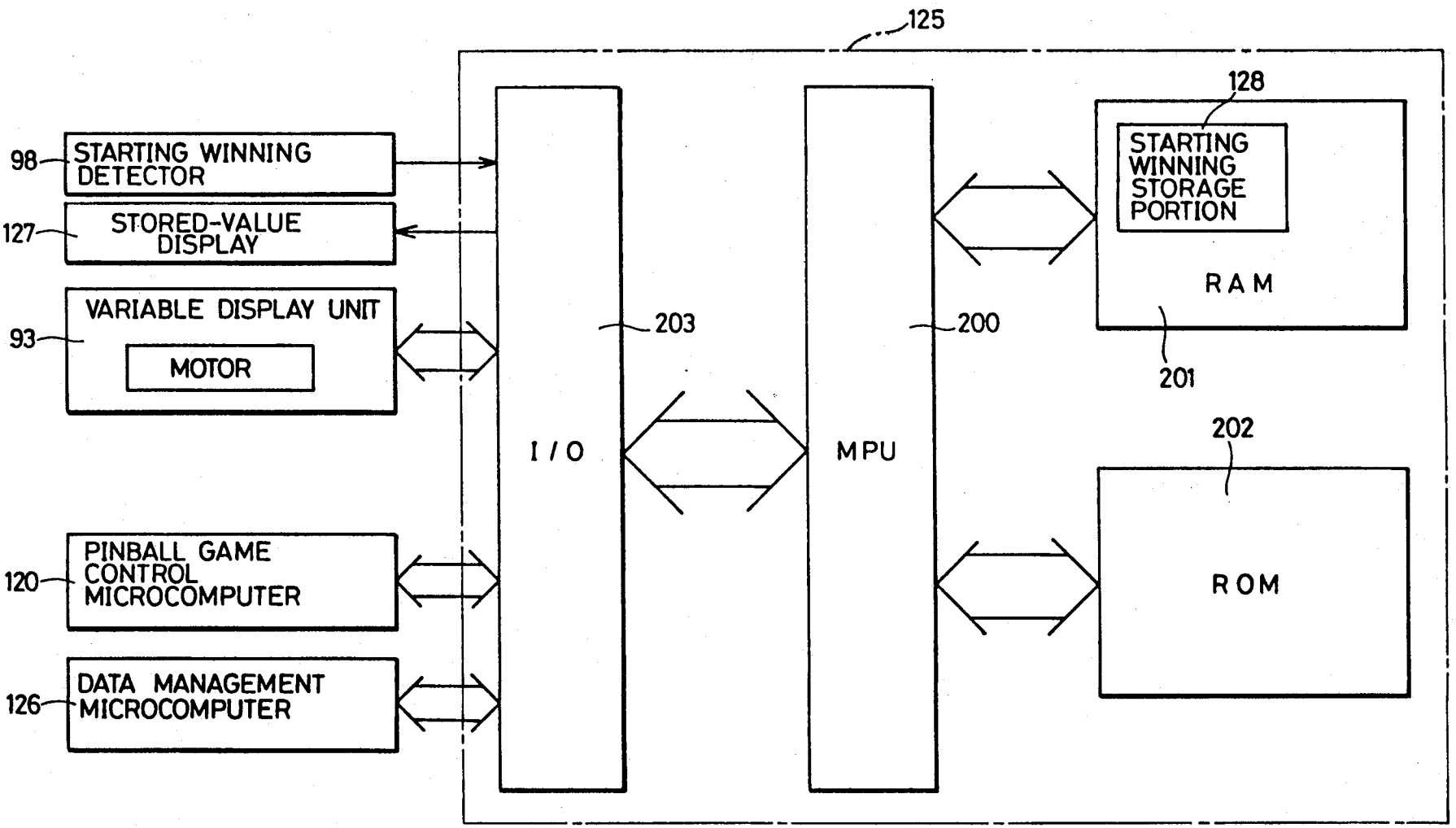
FIG. 9 is a block diagram showing a microcomputer for drum control, and a control circuit including various devices connected to the microcomputer.

FIG. 9 is a block diagram showing the drum control microcomputer and a control circuit including various apparatuses connected to the microcomputer. This drum control microcomputer 125 has approximately the same structure as that of the above-described game control microcomputer 120. The same reference characters denote the same portions or components as those of game control microcomputer 120, and hence a description thereof will not be repeated here.

An RAM 201 in drum control microcomputer 125 includes a starting winning storage portion (a starting counter) 128 for storing the number of starting winnings therein. When a ball falls into the starting passage winning hole (see FIG. 1), detector 98 for detecting the ball falling into the starting passage winning hole is turned on, so that a signal for detecting the starting winning is applied to drum control microcomputer 125. Starting winning storage portion 128 responds to the starting winning detection signal to store the number of starting winnings therein. A control signal for displaying a stored value thereof is applied to a stored-value display 127 (see FIG. 1). Transmission of control signals is carried out between variable display unit 93 (see FIG. 1) and drum control microcomputer 125. Detection signals of position detectors 111*a*–111*c* mounted on variable display unit 93 are applied to drum control microcomputer 125. A control signal for driving each of rotation motors 107*a*–107*c* (see FIG. 7) is output from drum control microcomputer 125 to variable display unit 93. Game control microcomputer 125 carries out data transmission between microcomputer 120 for pinball game control and microcomputer 126 for data management.

Figure 10:
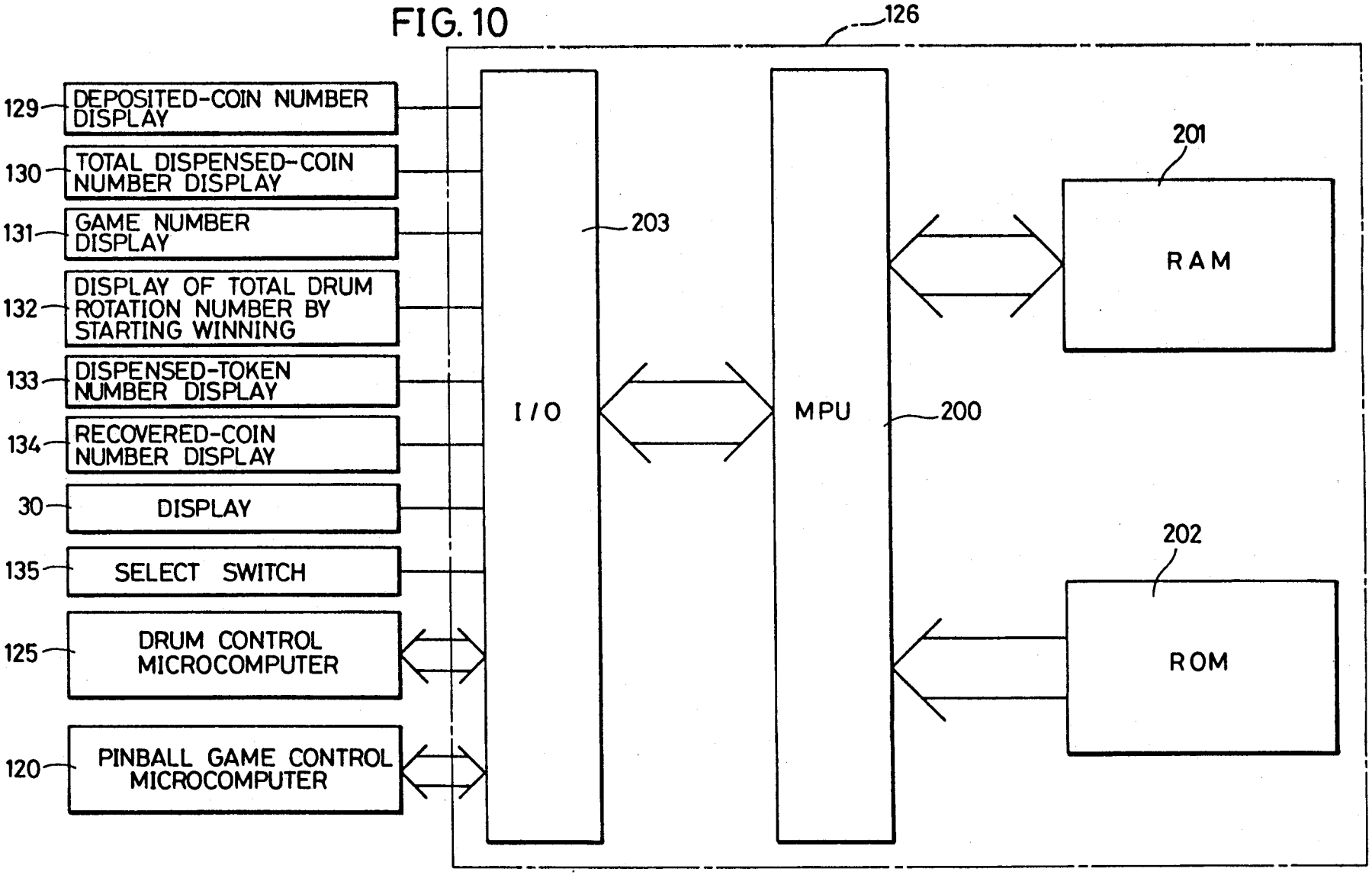
FIG. 10 is a block diagram showing a microcomputer for data management, and a control circuit including various devices connected to the microcomputer.

FIG. 10 is a block diagram showing data management microcomputer 126 and a control circuit including various apparatuses connected to the microcomputer. This data management microcomputer 126 has the same structure as that of the above-described game control microcomputer 120. Like reference characters denote like portions or like components, and hence a description thereof will not be repeated here.

Data management microcomputer 126 applies a control signal for displaying the number of deposited coins to deposited-coin number display 129 (see FIG. 2). A control signal for displaying the total number of dispensed coins is applied to total dispensed-coin number display 130. A control signal for displaying how many games have been played since a power supply was turned on is applied to game number display 131 (see FIG. 2). A signal for displaying how many times the drum has rotated in total due to the starting winning is applied to total drum rotation number display 132. A signal for displaying the number of dispensed tokens is applied to dispensed-token number display 133 (see FIG. 2). A signal for displaying the number of recovered coins is applied to recovered-coin number display 134 (see FIG. 2). If select switch 135 (see FIG. 2) is pressed, then the select switch is turned on, so that a select detection signal thereof is applied to data management microcomputer 126. Data management microcomputer 126 responds to the signal applied from select switch 135 to determine which type of the game information shown in FIG. 16 should be displayed, and thus apply a display signal to a display 30 (which also serves as the credit number display). Data transmission is carried out between drum control microcomputer 125 and data management microcomputer 126. Data management microcomputer 126 responds to the signal applied from drum control microcomputer 125 to calculate the total number of rotations of the drum due to the starting winning and output the calculated number. Data transmission is carried out between pinball game control microcomputer 120 and data management microcomputer 126. Pinball game control microcomputer 126 applies signals such as a signal required to display the number of deposited coins, a signal required to display the total number of dispensed coins, a signal required to display the number of games, a signal required to display the number of dispensed tokens, a signal required to display the number of recovered coins and the like, to data management microcomputer 126.

Figure 11A:
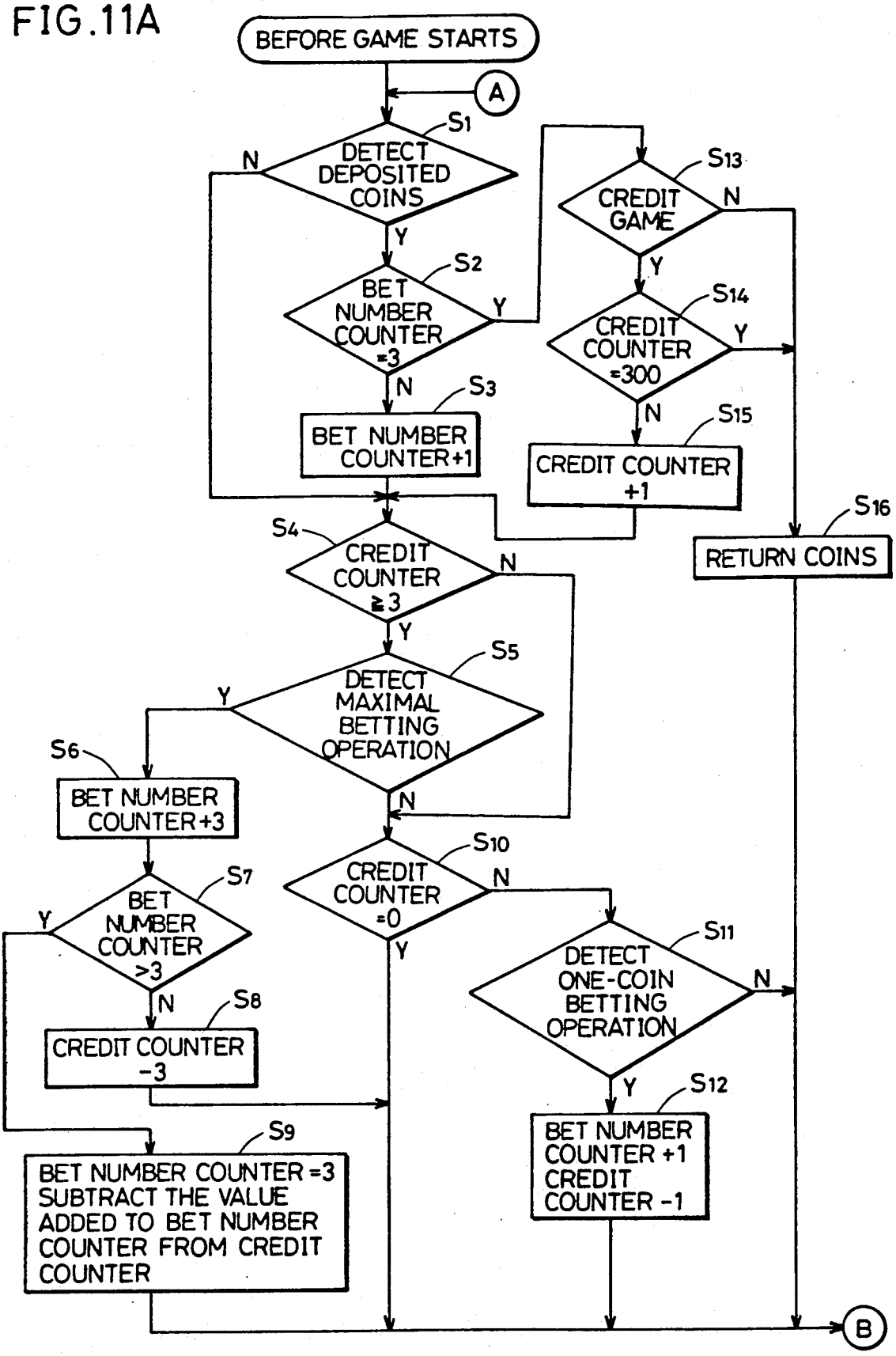
Figure 11B:
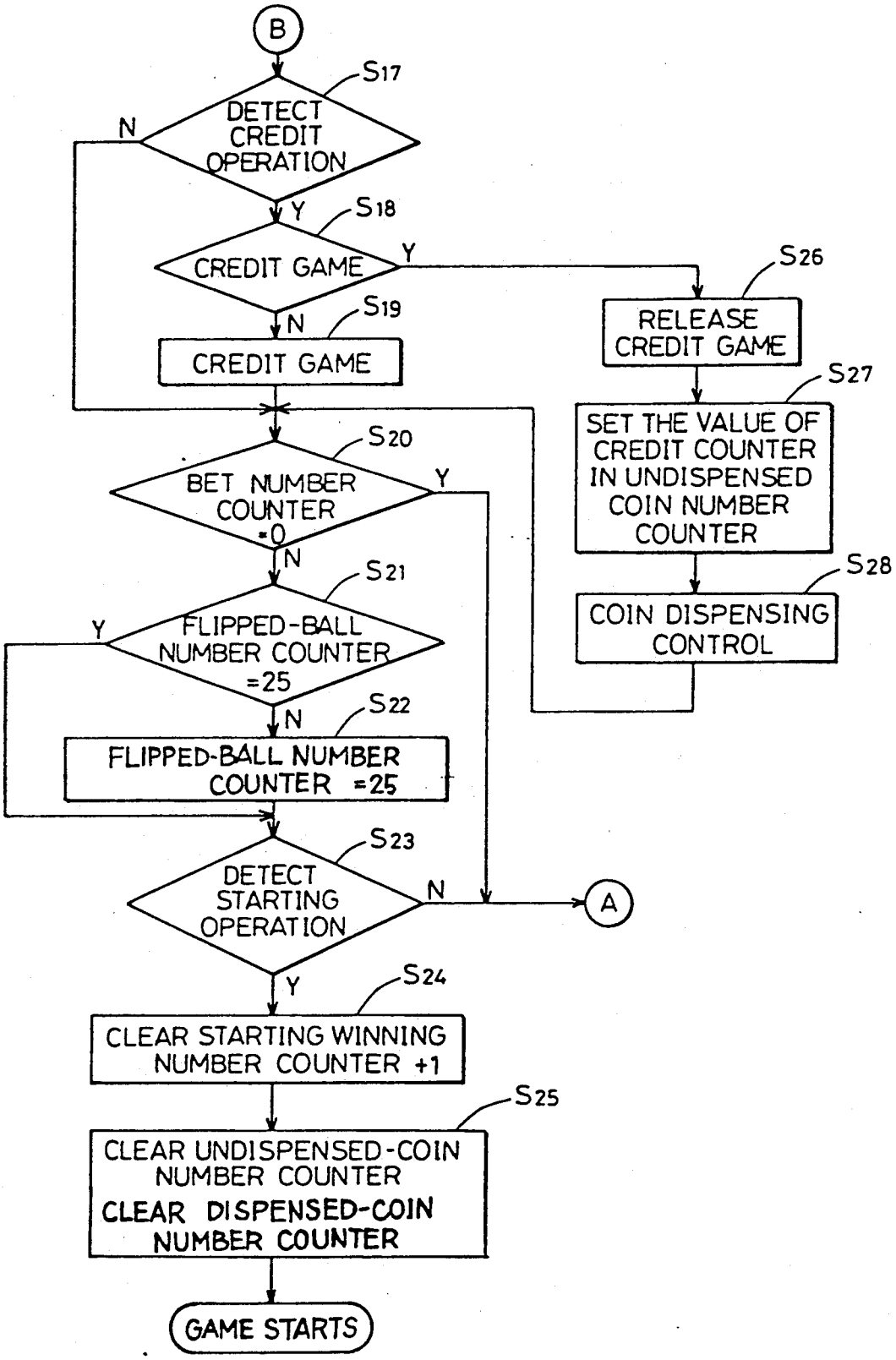
Figure 13:
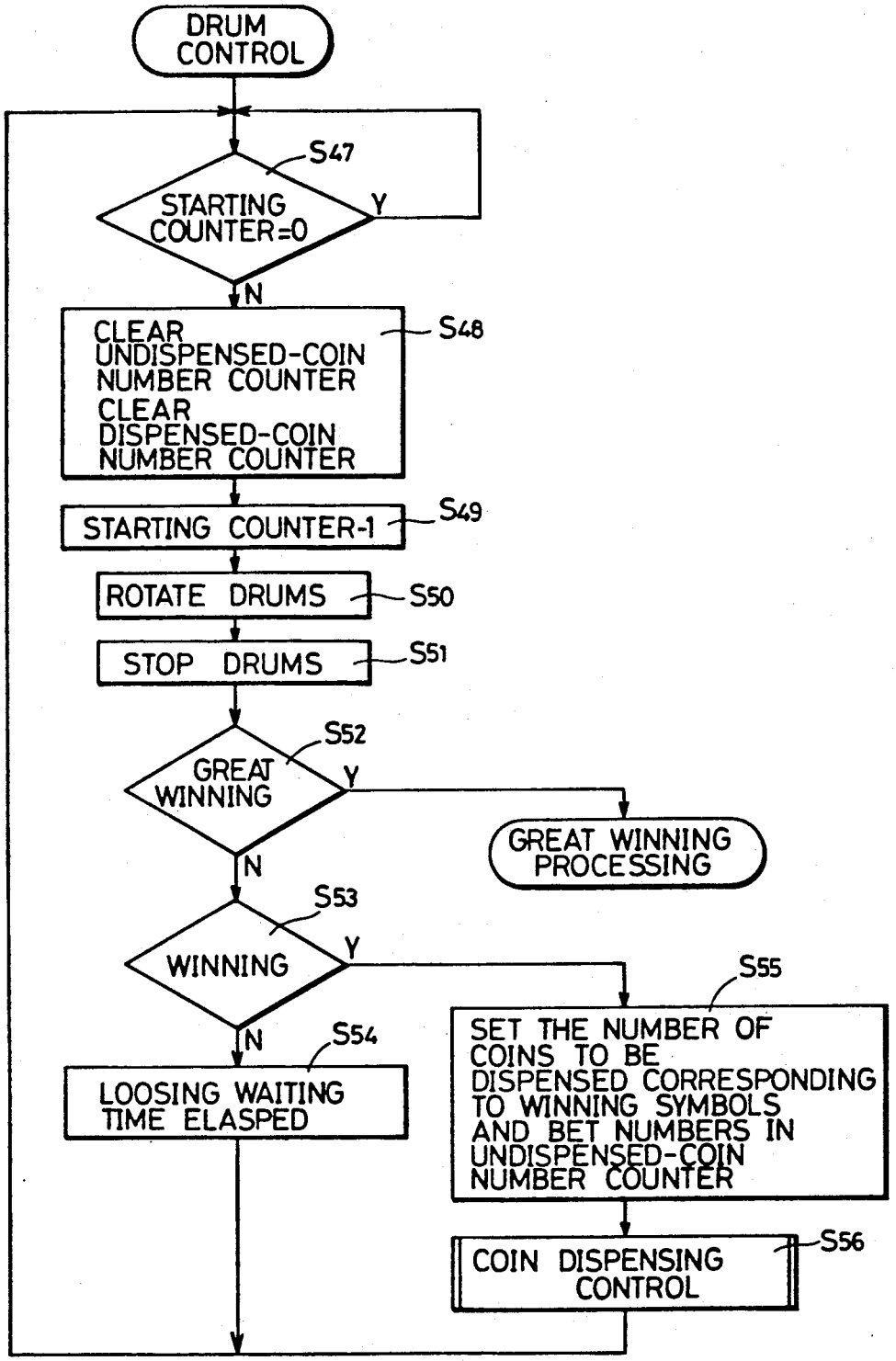
FIGS. 13 and 14 are flow charts for use in explaining the operation of the control circuit shown in FIG. 9.
Figure 14:
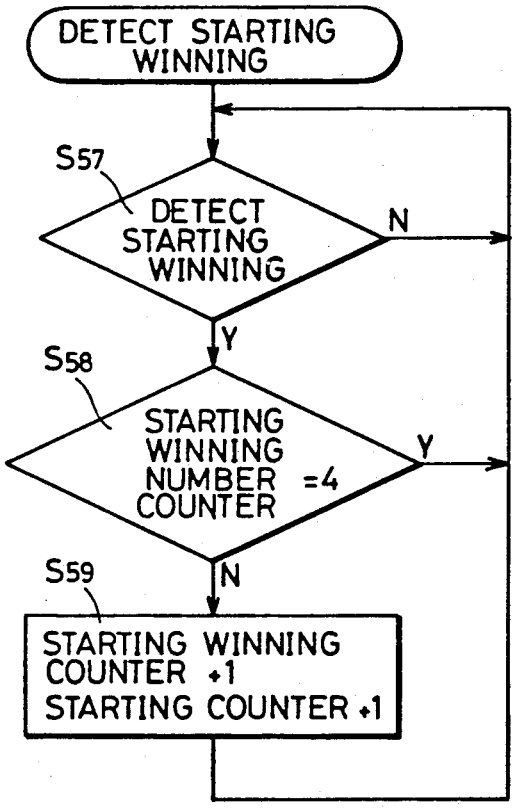
Figure 15:
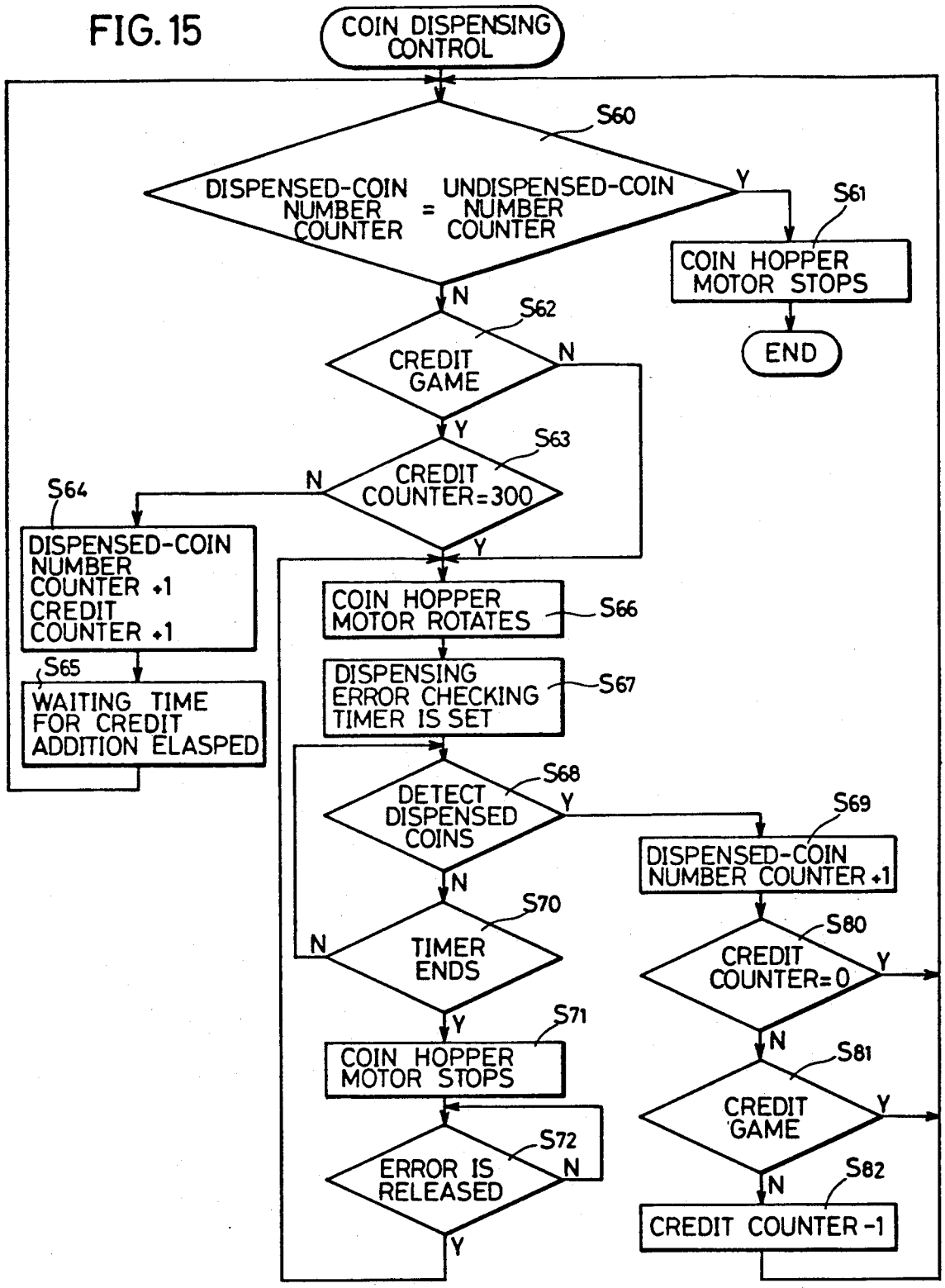
Figure 17:
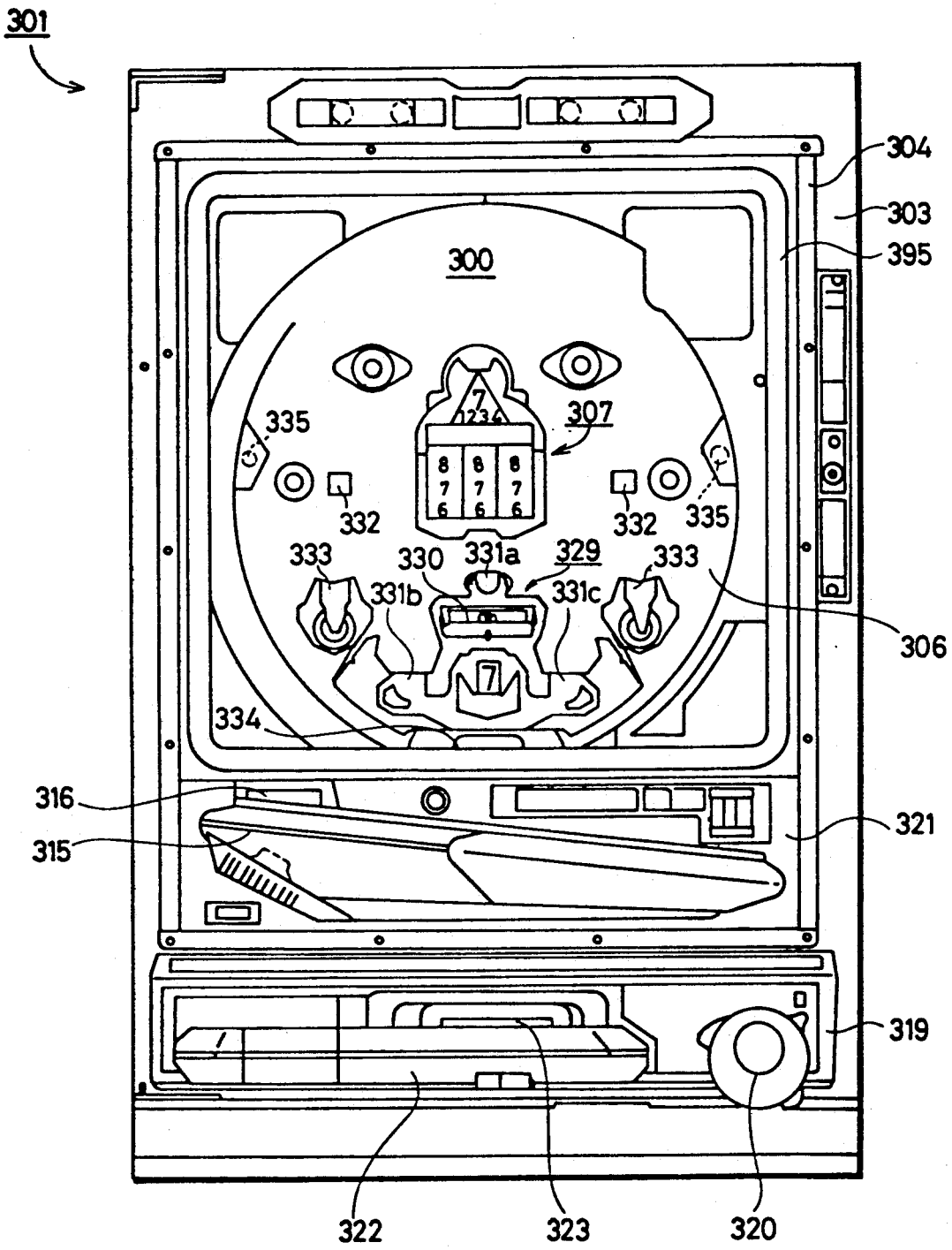
FIG. 17 PRIOR ART
FIG. 17 is an overall front view showing a pinball game machine being one example of conventional flipped ball game machines.
Figure 18:
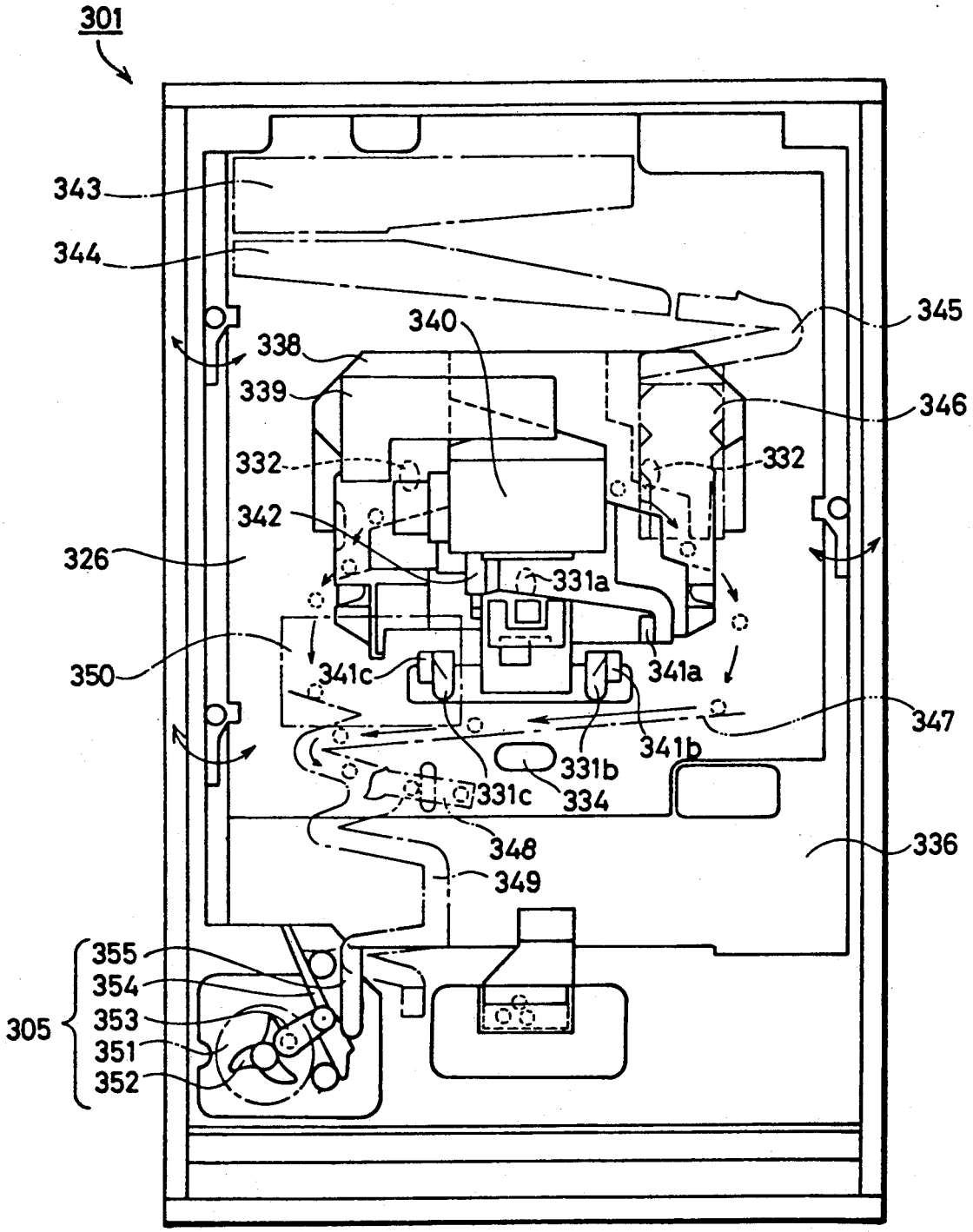
FIG. 18 PRIOR ART
FIG. 18 is an overall rear view showing an internal structure of part of the conventional pinball game machine.
Figure 19:
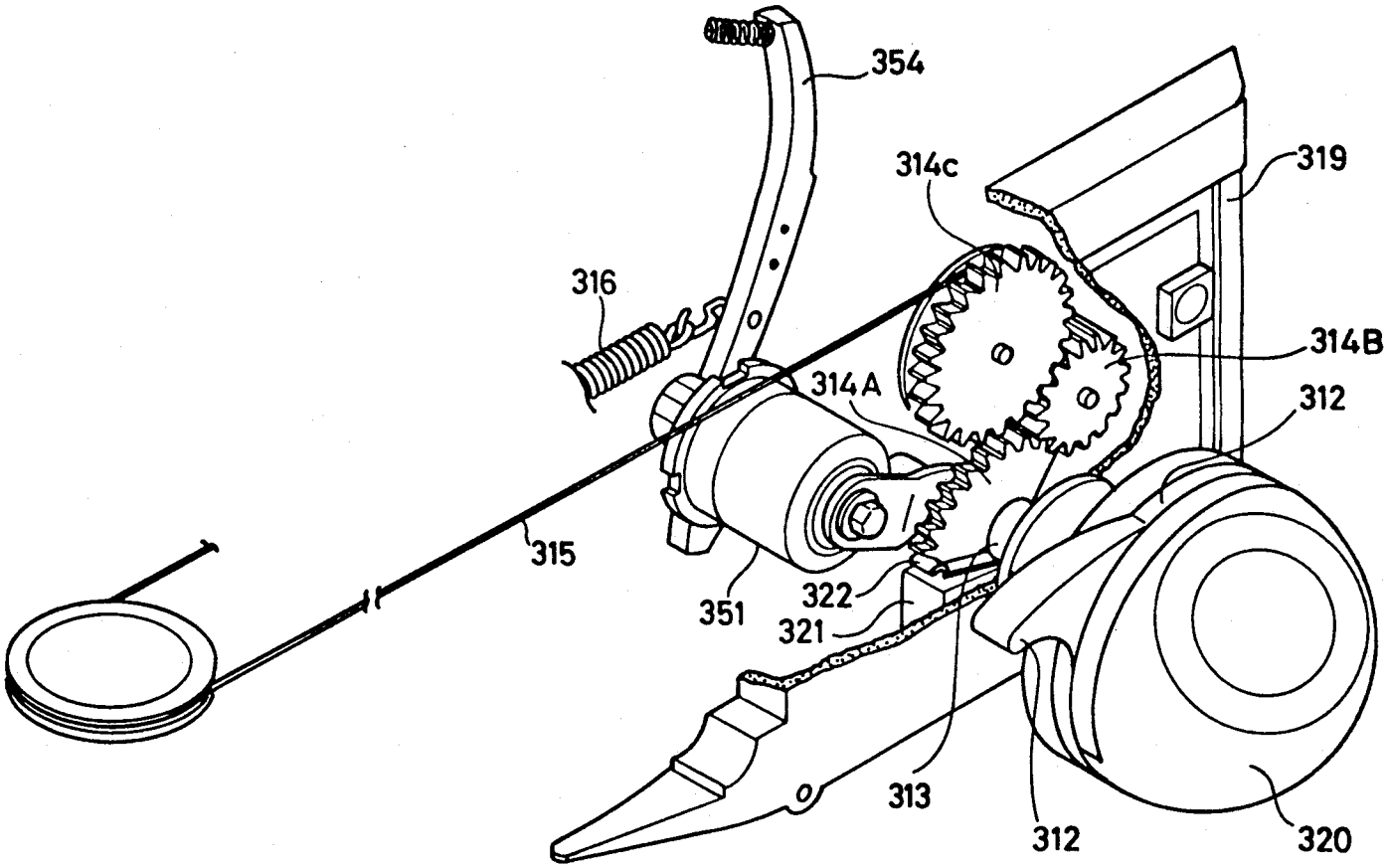
FIG. 19 PRIOR ART
FIG. 19 is a perspective view showing a ball shooting mechanism provided in the conventional pinball game machine.

FIGS. 11A and 11B, 12 and 15 are flow charts for use in explaining the operation of the control circuit shown in FIG. 8. FIGS. 13 and 14 are flow charts showing the operation of the control circuit shown in FIG. 9. FIGS. 11A and 11B are flow charts showing a control before a game is started; FIG. 12 is a flow chart showing a control of balls after the game is started; FIG. 13 is a flow chart showing a control of rotating drums; FIG. 14 is a flow chart for use in explaining a detection of the starting winning; and FIG. 15 is a flow chart for use in explaining a control of dispensing coins.

A determination is made as to whether or not a deposited coin is detected, in step (hereinafter referred to simply as "S") 1 shown in FIGS. 11A and 11B. If the coin is not deposited yet, the control proceeds to S4. If the player deposits a coin through coin deposit slot 18 (see FIG. 1), the deposited coin is detected by deposited-coin detector 22, so that the control proceeds to S2. A determination is made as to whether or not a bet number counter indicates "3", in S2. The bet number counter is a counter for counting the number of betted coins input and set by the player who operates one-coin bet button 25 or maximal bet button 26 in a credit game or counting the number of deposited coins in a coin-operated game. The player can bet up to "3" at maximum as described above. Respective predetermined values are added to a count value of this bet number counter in respective steps S3, S6 and S12 which will be described later, and after one game is over, the resultant count value is cleared. If the count value of the bet number counter is not "3" yet, a processing of adding "1" to the count value of the bet number counter, corresponding to the deposit of coins, is carried out in S3. If the count value of the bet number counter is already the maximal value "3", the control proceeds to S13 in which a determination is made as to whether a credit game is to be played or not. More specifically, the deposit of coins despite the fact that the count value of the bet number counter is already the maximal value "3" means that such a case may be considered that the player intends to play the credit game, in which the player deposits a large number of coins in advance and then credits the deposited coins to play the game repetitively. Thus, the determination is first made as to whether or not the game is the credit game, in S13. If the credit game is not determined in S13, then the coins deposited exceeding an upper limit value of the bet number are returned to the player in S16, and the control proceeds to S17. Conversely, if the credit game is determined, then the control proceeds to S14 in which a determination is made as to whether the count value of a credit counter is a maximal value "300" or not. If the count value is not the upper limit value "300" yet, since there is a margin, a processing of adding "1" to the count value of the credit counter, corresponding to the number of the deposited coins, is made in S15, and thereafter the control proceeds to S4. Conversely, if the count value of the credit counter is already the upper limit value "300", then the control proceeds S16 in which the coins deposited exceeding the upper limit value of the credit counter are returned to the player. Next, a determination is made as to whether the count value of the credit counter is not lower than "3", in S4. If three or more coins are deposited in the state of the credit game, then YES is determined in S4, and the control proceeds to S5 in which a determination is made as to whether a maximal betting operation has been carried out or not. If the player manipulates maximal bet button 26 (see FIG. 1), the control proceeds to S6 in which "3" is added to the count value of the bet number counter. The control then proceeds to S7 in which the relation satisfying the count value of the bet number counter $>3$ is determined. If the count value is not more than "3", then the control proceeds to S8 in which "3" is subtracted from the count value of the credit counter. After that, the control proceeds to S17. More specifically, in the case of the credit game, when a maximal betting operation, i.e., an operation of betting three deposited coins is carried out, it is necessary to subtract the coins to be bet from the deposited coins that have already been credited in advance and then bet the subtracted coins in the game. Thus, the subtraction processing is carried out in S8. When one to three coins are deposited to play a usual coin-operated game which is not the credit game, or when the maximal betting operation is carried out in the state where the count value of the bet number counter is already any one of the values "1", "2" and "3" by the one-coin betting operation, since "3" is further added to the count value of the bet number counter indicating "1", "2" or "3" (see S6), such a case is provided that the count value of the bet number counter becomes higher than "3". In this case, YES is determined in S7, and the control proceeds to S9 in which the count value of the bet number counter is set to "3" and the value added to the count value is subtracted from the count value of the credit counter. Then, the control proceeds to S17. That is to say, when a maximal betting (three coins betting) operation is carried out in the state where a single coin, for example, is already deposited so as to play the usual coin-operated game in the credit game, the count value "2", corresponding to the two coins subtracted from the credit counter, is added to the one coin which is deposited for playing the usual coin-operated game, that is, the relation $1+2=3$ is satisfied. Thus, the count value of the bet number counter is set to "3".

When the game is not a credit game, or when the game is the credit game, but the number of deposited coins is less than three, the control proceeds to S10 in which it is determined whether the count value of the credit counter is "0" or not. The case where the count value of the credit counter is "0" is applied to the case where the game is not the credit game or the case where the game is the credit game, but even one coin is not yet deposited. In that case, the control proceeds to S17. Conversely, when the game is the credit game and at least one coin is already deposited, the control proceeds to S11 in which it is determined whether or not a one-coin betting operation is detected. If the one-coin betting operation is not detected, the control proceeds to S17. If the player manipulates one-coin bet button 25 (see FIG. 1), YES is determined in S11. The control then proceeds to S12 in which the count value of the bet number counter is incremented by "1" and also the count value of the credit counter is decremented by "1". After that, the control proceeds to S17. If the player presses one-coin bet button 25 (see FIG. 1) twice, the determination of YES is made twice in S11, so that the count value of the bet number counter is "2", which means a two-coin bet game is to be played.

A determination is made as to whether or not a credit operation is detected, in S17. If the credit operation is not detected, the control proceeds to S20. If the player presses credit button 25 (see FIG. 1), then the credit operation is detected and the control proceeds to S18 in which a determination is made as to whether or not the credit game is presently underway. If the usual coin-operated game is currently underway, the control proceeds to S19 in which the usual game is changed to the credit game, and the control proceeds to S20. If the game is already changed to the credit game, YES is determined in S18, and the control proceeds to S26 in which the credit game is released. Then, the control proceeds to S27. More specifically, if the credit operation is again carried out during the credit game, the credit game is released and replaced by the usual coin-operated game. In S27, the value of the credit counter provided at the time point when the credit game is released in S26 is set in an undispensed-coin number counter. After a coin dispensing control is carried out in S28, the control proceeds to S20. The coin dispensing control in S28 will now be described in detail with reference to FIG. 15 which will be described later. In the coin dispensing control in S28, coins corresponding in number to the count value of the undispensed-coin number counter set in S27 are dispensed.

Next, a determination is made as to whether or not the count value of the bet number counter is "0", in S20. If the count value of the bet number counter is still "0", the control returns to S1. Then, the processings in S1 through S20 are repeated until a bet number is determined by manipulation by the player. If the bet number is determined by the player, the control proceeds to S21 in which a determination is made as to whether the count value of the flipped ball number counter is "25" or not. If the count value is not "25", then the count value is set to "25" in S22 and, thereafter, the control proceeds to S23. Conversely, if the count value of the flipped ball number counter is already "25", the control proceeds directly to S23. A determination is made in S23 as to whether or not a starting operation is detected. If the starting operation is not detected yet, the control returns to S1 again. If the player presses start button 27 (see FIG. 1) in the course of the loop returning to S1, YES is determined in S23. The control then proceeds to S24 in which a starting winning number counter is cleared and the count value of a starting counter is incremented by "1". The starting winning number counter serves to count the number of winning balls that have fallen into starting passage winning hole 8 (see FIG. 1) during the course of one game, and the starting winning number counter undergoes the addition processing in S59 which will be described later. An upper limit count value of the starting winning number counter is settled to "4". Thus, even if four or more balls, corresponding to the value "4" or the values higher than "4", fall into the starting passage winning hole, the winnings exceeding the value "4" are neglected. The starting counter serves to count the number of starting winnings in order to cause the variable display unit to make a variable display by the number of starting winnings, with its upper limit number being set to 4. The count value of the starting counter is counted up in S59 which will be described later. Then, the control proceeds to S25 in which the undispensed-coin number counter is cleared and also a dispensed-coin number counter is cleared. The control then proceeds to S30 in which the game is started. The undispensed-coin number counter serves to count the number of coins to be dispensed to the player, whereas the dispensed-coin number counter serves to count the number of coins dispensed to the player. Since it is necessary to clear the respective values of the undispensed-coin number counter and the dispensed-coin number counter in a previous game before the present game is started and thus start both the counters counting from "0", both the counters are cleared in S25. In S1 through S28, starting condition determining means is provided for determining satisfaction of game stating conditions which can be satisfied with the minimal requirements that a valuable object having a predetermined value usable in the game is deposited.

Next, ball flipping hammer 84 (see FIG. 4) is swung by a processing of rotating the ball shooting motor in S30 shown in FIG. 12. Then, the control proceeds to S31 in which a determination is made as to whether or not the timing of the hammer is detected, and the control waits until the timing detection is made. If hammer 84 swings and the light projected from hammer timing detector 90 (see FIG. 4) is intercepted by intercepting plate 86, then hammer timing detector 90 changes from an ON state to an OFF state. Further, if hammer 84 swings and the interception of the projected light is released by saving of intercepting plate 86, then hammer timing detector 90 changes from the OFF state to the ON state again. The timing at which timing detector 90 is turned on is detected, and YES is determined in S31. The control then proceeds to S32. A determination is made in 32 as to whether or not the hammer timing is again detected. If the hammer timing is not detected yet, the control proceeds to S45 in which a determination is made as to whether a foul ball is detected or not. If no foul ball is detected, then the control again returns to S32. If hammer 84 swings again and the second timing is detected in the course of the loop returning to S32, then YES is determined in S32, and the control proceeds to S33 in which the shot-ball feeding solenoid operates once for the first time, so that a ball is supplied to a ball shooting position. The reason why the ball is not supplied to the ball shooting position until the hammer swings twice is that the number of revolutions of shooting motor 80 has not yet reached a desired number of revolutions when hammer 84 makes a first swing, and that hammer 84 makes an empty flipping or shooting at the first swing to cause approach running of motor 80 and then makes a first flipping or shooting of the ball when motor 80 rotates at higher speed. Then, the control proceeds to S34 in which a determination is made as to whether or not the shot ball is detected. If the shot ball is not detected yet, then the control proceeds to S45. Conversely, if the ball supplied to the ball shooting position is detected by ball delivery detector 78 (see FIG. 4), YES is determined in S34, and the control proceeds to S35 in which the count value of a flipped-ball number counter is decremented by "1". The flipped-ball number counter serves to count how many remaining balls can be flipped in the course of one game. The count value of the flipped-ball number counter is "25" at the time when one game is started. Then, the control proceeds to S36 in which a determination is made as to whether the count value of the flipped-ball number counter is set to "0". If 25 balls are not flipped yet, then the control proceeds to S45. If any foul ball is issued in the course of the game, the foul ball is detected by foul ball detector 73 (see FIG. 4), and YES is determined in S45. The control then proceeds to S46 in which the count value of the flipped-ball number counter is incremented by "1". The control thereafter returns to S32. If the flipped ball does not reach playfield 300 and returns to flipped ball supply passage 74 (see FIG. 4) again, since it is necessary to flip the returned foul ball again into playfield 300, the flipped-ball number counter is subjected to an addition processing on the basis of the foul ball in S46.

When 25 balls are already flipped and shot during one game, the count value of the flipped-ball number counter is set to "0", so that the control proceeds to S37 in which a determination is made as to whether or not the timing of ball flipping hammer 84 is detected. The fact that the count value of the flipped-ball number counter is "0" means that the 25th ball, i.e., the last ball is supplied to the ball shooting position. Since it is necessary to flip the 25th ball by hammer 84, a detection is made as to whether or not hammer 84 has been swung in order to flip the 25th ball, in S37. If the timing of hammer 84 is not yet detected, the control proceeds to S38 in which a detection is made as to whether a foul ball is generated or not. If no foul ball is generated, the control returns to S37. If any foul ball is generated in the course of the loop returning to S37, "1" is added to the count value of the flipped-ball number counter in S39 as mentioned above, and the control then returns to S32. If the hammer timing is detected, the 25th ball is flipped, so that the control proceeds to S40 in which the ball shooting motor is stopped. Then, the control proceeds to S41 in which a foul ball checking timer is set. This foul ball checking timer serves to time a waiting time for detecting a foul ball in the case where the 25th flipped ball returns as the foul ball without reaching playfield 300. A determination is made as to whether or not the foul ball is detected, in S42. If the foul ball is not yet detected, the control proceeds to S44 in which a determination is made as to whether the foul ball checking timer completes its timing or not. The determination in S42 is continued until this foul ball checking timer completes timing. If the foul ball is detected before the foul ball checking timer finishes timing, the count value of the flipped-ball number counter is incremented by "1" in S43 as mentioned above, so that the control returns to S30. Conversely, if the foul ball checking timer finishes timing without any foul ball detected, then a ball flipping control is terminated and the game of that round is over. In S30 through S44, flipping mechanism automatically controlling means is provided which is responsive to a determination output of the starting condition determining means for driving the flipping mechanism to automatically flip and shoot a ball by a predetermined flipping force.

Description will now be made on a program for detecting a starting winning shown in FIG. 14.

First, a determination is made as to whether or not any starting winning is detected in S57. The control keeps waiting until the starting winning detection is made. If a flipped ball falls into starting passage winning hole 8 (see FIG. 1), then this winning ball is detected by starting winning ball detector 98, and YES is determined in S57. The control then proceeds to S58 in which a determination is made as to whether or not the count value of the starting winning number counter is "4". If the count value of the starting winning number counter is not yet "4" which is an upper limit value of the starting winning that becomes effective in one game, the control proceeds to S59 in which the count value of the starting winning number counter is incremented by "1" and also the count value of the starting counter is incremented by "1". The control then returns to S27. Conversely, if the count value of the starting winning number counter is already set to the upper limit value "4", YES is determined in S58 in order to prevent a further addition processing of the starting counter. The control returns to S57 without carrying out the processing of S59. The respective values of the starting winning number counter and the starting counter subjected to the addition processing in S59 are transmitted from drum control microcomputer 125 to pinball game control microcomputer 120.

Description will now be made on a drum control program shown in FIG. 13.

First, a determination is made as to whether or not the count value of the starting counter is "0", in S47. The control keeps waiting until the count value of the starting counter is no longer "0". When the count value of the starting counter is incremented by "1" in S24 by a starting operation, or when a starting winning occurs, NO is determined in S47. The control then proceeds to S48 in which the undispensed-coin number counter and also the dispensed-coin number counter are cleared. In S48, the undispensed-coin number counter and the dispensed-coin number counter in the previous drum control are cleared, so that a counting is started from "0". Then, the control proceeds to S49 in which the count value of the starting counter is decremented by "1". The control then proceeds to S50 in which the drums are rotated, and then proceeds to S51 in which the drums are stopped. Then, the control proceeds to S52 in which a determination is made as to whether or not the combination of identification information displayed by the stopped rotating drums is a great-winning combination (e.g., 777). If the combination of the identification information is the great-winning combination, a great-winning processing is carried out. In this great-winning processing, the game is immediately interrupted, and the clerk in the game house pays out checks or coins to the player. If the clerk manipulates a reset switch (not shown) mounted in the flipped ball game machine after having paid the reward to the player, then the flipped ball game machine returns to its initial state, enabling the restart of the game. If the combination of the identification information is not the great-winning combination, the control proceeds to S53 in which a determination is made as to whether or not the winning is an ordinary winning. If the winning is the ordinary winning, the control proceeds to S55 in which the number of coins to be dispensed, corresponding to winning designs or symbols and a bet number, is set in the undispensed-coin number counter. The number of coins to be dispensed is set such that coins twice as many as coins dispensed in the case of one-coin betting are dispensed in the case of two-coin betting and that coins three times as many as those in the case of one-coin betting are dispensed in the case of maximal coin number betting (three-coin betting). Then, the control proceeds to S56 in which coin dispensing control is made, and then returns to S47. The coin dispensing control in S56 will be described later with reference to FIG. 15. If it is then determined that the identification information combination is not a winning combination in S53, the control proceeds to S54 and, after a waiting time for loosing has elapsed, the control returns to S47. The loosing waiting time is a waiting time which is necessary for the variable display unit to stop for a definite short period and makes the player confirm that he/she loses the game.

As has been mentioned in the foregoing, variable display unit 7 starts a display variation so that the count value of the starting counter may be "1" at the time point when the game is started with deposit of coins. Since the upper limit value countable by the starting counter is "4", variable display unit 7 varies the display five times maximally during one game, including the display variation provided when the game is started. Variable display unit 7 may vary the display twice maximally during one game, with the upper limit value countable by the starting counter being set to "1". Alternatively, variable display unit 7 may vary the display only once at the same time one game is over.

While such a constant probability that the combination of identification information for a great winning or ordinary winning is established when variable display unit 7 stops operation has been described in this embodiment, the probability for establishing the combination of the identification information may improve depending on an increase in the number of winning balls falling into starting passage winning hole 8.

Description will now be made on the coin dispensing control with reference to FIG. 15.

First, a determination is made as to whether or not the count value of the dispensed-coin number counter and that of the undispensed-coin number counter match each other, in S60. If the respective count values do not match each other, the control proceeds to S62 in which a determination is made as to whether or not the game is a credit game. If the game is not the credit game, the control proceeds to S66. Conversely, if the game is the credit game, the control proceeds to S63 in which a determination is made as to whether the count value of the credit counter is its maximal value of "300" or not. If the count value is not "300", then the control proceeds to S64 in which the respective count values of the dispensed coin number counter and the credit counter are incremented by "1". Then, the control proceeds to S65 and after a waiting time for credit addition has elapsed, the control returns to S60. This credit addition waiting time in S65 causes the credit count value displayed by credit coin number display 30 (see FIG. 1) to change slowly with an interval of the credit addition waiting time. This makes it possible for the player to visually recognize the change of the value of the credit counter.

If the count value of the credit counter is "300", the control proceeds to S66 in which the coin hopper motor is rotated. A dispensing error checking timer is set in S67, and a determination is then made as to whether dispensed coins are detected or not in S68. If the dispensed coins are not detected, the control proceeds to S70 in which a determination is made as to whether the dispensing error checking timer completes timing or not. The determination in S68 is continued until the dispensing error checking timer completes timing. If the dispensed coins are detected before the dispensing error checking timer completes timing, then the control proceeds to S69 in which the count value of the dispensed-coin number counter is incremented by "1". Then, the control proceeds to S80 in which a determination is made as to whether the count value of the credit counter is "0" or not. If the count value of the credit counter is "0", the control returns to S60. If YES is determined in S63, since the count value of the credit counter is not "0" and the game is the credit game, YES is determined in S81. The control then returns to S60. If the count value of the credit counter is not "0" and the game is not the credit game, i.e., coins are dispensed when the credit game is released, then the control proceeds to S82. After the count value of the credit counter is decremented by "1", the control returns to S60. Thus, in the credit game, the addition processing of the credit counter is first made in place of the actual dispensing of coins. After the count value of the credit counter is set to the maximal value "300", a further addition processing cannot be made, and hence the coins are actually dispensed.

If no dispensed coins are detected until the dispensing error checking timer completes timing, the control proceeds to S71 to stop the coin hopper. The control waits until the clerk in the game house releases the errors in S72. A possible specific example in which YES is determined in S70 is, for example, the case where there are no more coins in the coin hopper or the case where coins are clogged somewhere in their course. If the clerk presses a reset button (not shown) after appropriately handling such cases, YES is determined in S72, and the control returns to S66.

FIG. 16 is a diagram showing information printed out by printer 137 (see FIG. 2).

Referring to FIG. 16, various information of the game machine provided on May 12, 1990, 11:30 p.m. are printed. The contents of the printed information are: the number of games that have been played after the door (front frame 3) was closed is 184; the number of games that have been played since the power supply was turned on, i.e., the game house was opened is 313; the number of games that have been played by one-coin deposit, i.e., one-coin bet is 96; the number of games that have been played by two-coin deposit, i.e., tow-coin bet is 31; the number of games that have been played by three-coin deposit, i.e., three-coin bet is 186; the total amount of winning, i.e., the amount of coins recovered into the flipped ball game machine is 388 yen; and the number that the door (front frame 3) was opened is 2.

While the flipped ball game machine, into which the player deposits coins as one example of a valuable object to play games, has been described in this embodiment, the present invention is not limited to this. A flipped ball game machine may be applied that the player inserts a card which is one example of a recording medium on which information capable of specifying a predetermined value is recorded, and the player can play a game by using the value specified by the card. Alternatively, a probability for a great winning or ordinary winning may be varied depending on a bet number. A possible method of the probability variation is to provide five winning effective lines of variable display unit 7 in laterally three rows and diagonally two columns and vary the number of effective lines to be determined for a great winning or an ordinary winning dependently on the bet number, or vary an internal probability by a control program of a control microcomputer. Further, the probability of occurrence of a great winning or an ordinary winning may be changed or controlled in the game house. In addition, the bet number may be fixed to, for example, only a one-coin betting. In such a case, the game may be started immediately by deposit of coins corresponding in number to the bet number or by manipulation of the bet number button without manipulation of the start button.

As has been described heretofore, according to the embodiment of the present invention, such a flipped ball game machine can be provided that since balls are flipped and shot by a predetermined flipping force, the player can enjoy chances under less influence caused by the player's skill of flipping the balls as well as enjoy the falling state of the balls flipped into the playfield.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A flipped ball game apparatus having a playfield into which a ball is shot and moves leaving an indefinite trajectory, wherein a predetermined play value can be provided to a player in accordance with the trajectory of the ball moving in the playfield, said apparatus comprising:

ball shooting means for shooting a ball toward said playfield;

starting condition determining means for determining whether game starting conditions necessary to start a game are satisfied or not; and ball shooting automatically controlling means for automatically driving and controlling said ball shooting means to automatically shoot the ball in accordance with the result of the determination indicating that the game starting conditions by said starting condition determining means are satisfied.

2. The flipped ball game apparatus according to claim 1, wherein said ball shooting means includes shooting force variably setting means capable of variably setting a shooting force to shoot a ball.

3. The flipped ball game apparatus according to claim 2, wherein said shooting force variably setting means includes, an adjacent portion capable of varying a shooting force by manual operation to adjust the shooting force, and shooting force fixing means for fixing the shooting force adjusted by the adjustment portion so as to avoid distortion of the shooting force.

4. The flipped ball game apparatus according to claim 1, wherein said ball shooting means includes a hammer for flipping and shooting the ball by hitting against the ball.

5. The flipped ball game apparatus according to claim 4, wherein said hammer is pivotally swung in a first direction to flip the ball and in a second direction opposite from the first direction, and the ball is flipped and shot by causing the hammer in the second direction to swing in the first direction to hit against the ball.

6. The flipped ball game apparatus according to claim 5, wherein said ball shooting means includes, spring force providing means having a predetermined spring for providing said hammer with a force for swinging said hammer in said first direction by utilizing a restoring force of the spring, and an electric drive source for swinging said hammer in said second direction opposite from said first direction.

7. The flipped ball game apparatus according to claim 6, wherein said ball shooting means includes shooting force variably setting means for variably setting the restoring force of said spring to set a desired magnitude of the ball shooting force.

8. The flipped ball game apparatus according to claim 7, wherein said shooting force variably setting means includes, a first member ganged with and connected with said spring and moving thereby to vary the amount of deformation of said spring, a second member fixed to a predetermined fixing member, contacting means for making said first member contact with said second member by pressing said first member onto said second member, and an adjustment pick-up manually operated by an operator for sliding said first member on the surface of said second member against a frictional force caused at the contact surface between said first member and said second member and changing the amount of deformation of said spring so as to adjust the restoring force of said spring, wherein when said adjustment pick-up is not operated, the frictional force caused at the contact surface between said first and second members prevents said first member from sliding on the surface of said second member, so as to fix the shooting force of the ball.

9. The flipped ball game apparatus according to claim 1, wherein said starting condition determining means includes valuable object using operation determining means for determining that a predetermined operation is carried out to use the value of a predetermined valuable object in a game.

10. The flipped ball game apparatus according to claim 9, wherein said valuable object using operation determining means includes, a valuable object receiving portion for receiving said valuable object, and valuable object reception detecting means for detecting that said valuable object is received in said valuable object receiving portion.

11. The flipped ball game apparatus according to claim 10, wherein said ball shooting means includes shooting force variably setting means capable of variably setting a shooting force for shooting the ball.

12. The flipped ball game apparatus according to claim 11, wherein said shooting force variably setting means includes, an adjustment portion capable of changing the shooting force by manual operation to adjust the shooting force, and shooting force fixing means for fixing the shooting force adjusted by said adjustment portion so as to avoid distortion of the shooting force.

13. The flipped ball game apparatus according to claim 9, wherein said valuable object using operation determining means includes, a game starting operation portion operated by a player for starting a game, and starting operation detecting means for detecting that said game starting operation portion is operated.

14. The flipped ball game apparatus according to claim 13, wherein said ball shooting means includes shooting force variably setting means capable of variably setting the shooting force to shoot the ball.

15. The flipped ball game apparatus according to claim 14, wherein said shooting force variably setting means includes, an adjustment portion capable of changing the shooting force by manual operation to adjust the shooting force, and shooting force fixing means for fixing the shooting force adjusted by said adjustment portion so as to avoid distortion of the adjusted shooting force.

16. The flipped ball game apparatus according to claim 9, wherein said valuable object using operation determining means includes, a valuable object receiving portion for receiving said valuable object, valuable object reception detecting means for detecting that said valuable object is received in said valuable object receiving portion, a game starting operation portion operated by a player to start a game, and starting operation detecting means for detecting that said game starting operation portion is operated.

17. The flipped ball game apparatus according to claim 1, wherein the number of balls allowed to be shot in a predetermined game of one unit is determined in advance, said apparatus further comprising one-unit game allowing means for allowing the one-unit game by shooting balls within said predetermined number into said playfield, using a value necessary to play said one-unit game.

18. The flipped ball game apparatus according to claim 17, wherein said starting condition determining means includes valuable object using operation determining means for determining that a predetermined operation is carried out to use the value of a predetermined valuable object in a game.

19. The flipped ball game apparatus according to claim 18, wherein said valuable object using operation determining means includes, a valuable object receiving portion for receiving said valuable object, and valuable object reception detecting means for detecting that said valuable object is received in said valuable object receiving portion.

20. The flipped ball game apparatus according to claim 18, wherein said valuable object using operation determining means includes, a game starting operation portion operated by a player to start a game, and starting operation detecting means for detecting that said game starting operation portion is operated.

21. The flipped ball game apparatus according to claim 17, wherein said one-unit game allowing means includes, ball shooting detecting means for detecting the shooting of a ball by said ball shooting means, counting means for counting the number of balls shot into said playfield in accordance with the result of the detection by said ball shooting detecting means, and ball shooting stopping means for stopping the shooting of the balls by said ball shooting means when a count value by said counting means reaches a value corresponding to said predetermined number of balls.

22. The flipped ball apparatus according to claim 21, wherein said starting condition determining means includes valuable object using operation determining means for determining that a predetermined operation is carried out to use the value of the predetermined valuable object in the game.

23. The flipped ball apparatus according to claim 22, wherein said valuable object using operation determining means includes, a valuable object receiving portion for receiving said valuable object, and valuable object reception detecting means for detecting that said valuable object is received in said valuable object receiving portion.

24. The flipped ball game apparatus according to claim 22, wherein said valuable object using operation detecting means includes a game starting operation portion operated by a player to start a game, and starting operation detecting means for detecting that said game starting operation portion is operated.

25. The flipped ball game apparatus according to claim 21, further comprising foul ball detecting means for detecting foul balls out of the balls shot by said ball shooting means, which have not reached said playfield due to an insufficient shooting force of said ball shooting means, wherein said counting means includes removed-foul ball counting means for removing the number of foul balls detected by said foul ball detecting means from said count value of the balls.

26. The flipped ball game apparatus according to claim 17, further comprising value storing means responsive to an operation for storing in advance the value of said valuable object which is plural times as large as the value used in said one- unit game so as to use the plural-time value in a game, for storing said value for use in the game; and game repetition allowing means for allowing repetition of said one-unit game with satisfaction of said game repetition allowing means satisfied under such necessary conditions that the remaining value stored in said value storing means is equal to or higher than the value necessary to play said one-unit game, said remaining value being obtained by decreasing the value stored in said value storing means, used in said one-unit game.

27. The flipped ball game apparatus according to claim 26, wherein said starting condition determining means includes valuable object using operation determining means for determining that a predetermined operation is carried out to use the value of a predetermined valuable object in a game.

28. The flipped ball game apparatus according to claim 27, wherein said valuable object using operation determining means includes, a valuable object receiving portion for receiving said valuable object, and valuable object reception detecting means for detecting that said valuable object is received in said valuable object receiving portion.

29. The flipped ball game apparatus according to claim 27, wherein said valuable object using operation determining means includes, a game starting operation portion operated by a player to start a game, and starting operation detecting means for detecting that said game starting operation portion is operated.

30. The flipped ball game apparatus according to claim 1, wherein said ball shooting means includes ball supply means for supplying a ball to a predetermined ball shooting position at which the ball is shot; and said ball shooting automatically controlling means includes approach running operation controlling means for driving said ball shooting means to carry out an approach running operation without the supply of the ball by said ball supply means during a predetermined period in activation of said ball shooting means.

31. The flipped ball game apparatus according to claim 1, further comprising specific play state appearance means for causing a specific play state in which a predetermined play value can be provided to the player to appear in accordance with the ball shot into said playfield.

32. The flipped ball game apparatus according to claim 31, wherein said specific play state appearance means includes, variable display means for variably displaying plural types of identification information, and display stop controlling means for stopping the variable display by said variable display means to display said identification information in a stopped state, wherein said specific play state appears when the stopped display by said variable display means is predetermined specific identification information.

33. The flipped ball game apparatus according to claim 32, wherein said starting condition determining means includes valuable object using operation determining means for determining that a predetermined operation is carried out to use the value of a predetermined valuable object in a game.

34. The flipped ball game apparatus according to claim 33, wherein said valuable object using operation determining means includes, a valuable object receiving portion for receiving said valuable object, and valuable object reception detecting means for detecting that said valuable object is received in said valuable object

35. The flipped ball game apparatus according to claim 33, wherein said valuable object using operation determining means includes, a game starting operation portion operated by a player to start a game, and starting operation detecting means for detecting that said game starting operation portion is operated.

36. A flipped ball game apparatus having a playfield into which a ball is shot and moves leaving an indefinite trajectory, for shooting the ball into said playfield to play a game, said apparatus comprising: ball shooting means for shooting a ball toward said playfield by using the value of a predetermined valuable object, wherein the rate at which the value of said valuable object is used for said ball shooting is determined in accordance with a predetermined coefficient; specific play state appearance means for causing a specific play state to appear in which a predetermined play value can be provided to a player in accordance with the trajectory of the ball shot into said playfield, wherein the rate at which said play value is provided is determined in accordance with a predetermined coefficient; and coefficient setting means for setting said coefficient to a desired value in accordance with an operation by the player.

37. The flipped ball game apparatus according to claim 36, further comprising: starting condition determining means for determining whether game starting conditions necessary to start a game are satisfied or not; and ball shooting automatically controlling means for automatically driving said ball shooting means to automatically shoot a ball in accordance with the result of the determination indicating that the game starting conditions by said starting condition determining means are satisfied.

38. The flipped ball game apparatus according to claim 37, wherein said ball shooting means includes shooting force variably setting means for variably setting a shooting force for shooting a ball.

39. The flipped ball game apparatus according to claim 38, wherein said shooting force variably setting means includes, an adjustment portion capable of changing a shooting force by manual operation to adjust the shooting force, and shooting force fixing means for fixing the shooting force adjusted by said adjustment portion so as to avoid distortion of the shooting force.

40. The flipped ball game apparatus according to claim 37, wherein said starting condition determining means includes valuable object using operation determining means for determining that a predetermined operation is carried out to use the value of a predetermined valuable object in a game.

41. The flipped ball game apparatus according to claim 40, wherein said ball shooting means includes shooting force variably setting means for variably setting a shooting force for shooting a ball.

42. The flipped ball game apparatus according to claim 41, wherein said shooting force variably setting means includes, an adjustment portion capable of changing the shooting force by manual operation to adjust the shooting force, and shooting force fixing means for fixing the shooting force adjusted by said adjustment portion so as to avoid distortion of the shooting force.

43. The flipped ball game apparatus according to claim 40, wherein said valuable object using operation determining means includes, a valuable object receiving portion for receiving said valuable object, and valuable object reception detecting means for detecting that said valuable object is received in said valuable object receiving portion.

44. The flipped ball game apparatus according to claim 43, wherein said ball shooting means includes shooting force variably setting means for variably setting a shooting force for shooting a ball.

45. The flipped ball game apparatus according to claim 44, wherein said shooting force variably setting means includes, an adjustment portion capable of changing the shooting force by manual operation to adjust the shooting force, and shooting force fixing means for fixing the shooting force adjusted by said adjustment portion so as to avoid distortion of the shooting force.

46. The flipped ball game apparatus according to claim 40, wherein said valuable object using operation determining means includes, a game starting operation portion operated by a player to start a game, and starting operation detecting means for detecting that said game starting operation portion is operated.

47. The flipped ball game apparatus according to claim 46, wherein said ball shooting means includes shooting force variably setting means for variably setting a shooting force for shooting a ball.

48. The flipped ball game apparatus according to claim 47, wherein said shooting force variably setting means includes, an adjustment portion capable of changing the shooting force by manual operation to adjust the shooting force, and shooting force fixing means for fixing the shooting force adjusted by said adjustment portion so as to avoid distortion of the shooting force.

49. The flipped ball game apparatus according to claim 40, wherein said valuable object using operation determining means includes, a valuable object receiving portion for receiving said valuable object, valuable object reception detecting means for detecting that said valuable object is received in said valuable object receiving portion, a game starting operation portion operated by the player to start a game, and starting operation detecting means for detecting that said game starting operation portion is operated.

50. The flipped ball game apparatus according to claim 36, wherein said specific play state appearance means includes, variable display means for variably displaying plural types of identification information, and display stop controlling means for stopping the variable display by said variable display means to display said identification information in a stopped state, wherein said specific play state appears when the stopped display by said variably display means is predetermined specific identification information.

51. The flipped ball game apparatus according to claim 36, wherein said coefficient setting means includes, a valuable object receiving portion for receiving said valuable object, value detecting means for detecting the degree of the value of said valuable object received in said valuable object receiving portion, and received-value setting means for setting as a coefficient the value of said valuable object received in said valuable object receiving portion in accordance with the result of the detection by said value detecting means.

52. The flipped ball game apparatus according to claim 51, wherein said coefficient setting means, wherein an upper limit of a coefficient that can be set is determined, includes reception rejecting means for rejecting the reception of the valuable object higher than the coefficient of the upper limit into said valuable object receiving portion.

53. The flipped ball game apparatus according to claim 52, wherein said reception rejecting means includes returning means for returning to the player the valuable object deposited into said valuable object receiving portion by the player.

54. The flipped ball game apparatus according to claim 36, wherein the number of balls allowed to be shot in a predetermined one-unit game is determined in advance, said apparatus further comprising one-unit game allowing means for allowing a one-unit game by shooting the balls within said predetermined number into said playfield, using a value necessary to play said one-unit game.

55. The flipped ball game apparatus according to claim 54, wherein said one-unit game allowing means includes, shooting detecting means for detecting the ball shooting by said ball shooting means, counting means for counting the number of balls shot into said playfield in accordance with the result of the detection by said shooting detecting means, and shooting stopping means for stopping the ball shooting by said ball shooting means when a count value provided by said counting means reaches a value corresponding to said predetermined number of balls.

56. The flipped ball game apparatus according to claim 54, further comprising:

value storing means responsive to an operation for storing in advance the value of said valuable object which is plural times as large as the value in said one-unit game so as to use the plural-time value in the game, for storing said value for use; and game repetition allowing means for allowing repetition of said one-unit game with satisfaction of said game repetition allowing means satisfied under such necessary conditions that the remaining value stored in said value storing means is equal to or higher than the value required in said one-unit game, said remaining value being obtained by decreasing the value stored in said value storing means, used in said one-unit game.

57. The flipped ball game apparatus according to claim 56, further comprising: starting condition determining means for determining whether game starting conditions necessary to start a game are satisfied or not; and ball shooting automatically controlling means for automatically driving said ball shooting means to automatically shoot a ball in accordance with the result of the determination indicating that the game starting conditions by said starting condition determining means are satisfied.

58. The flipped ball game apparatus according to claim 57, wherein said starting condition determining means includes valuable object using operation determining means for determining that a predetermined operation is carried out to use the value of a predetermined valuable object in a game.

59. The flipped ball game apparatus according to claim 58, wherein said valuable object using operation determining means includes, a valuable object receiving portion for receiving said valuable object, and valuable object reception detecting means for detecting that said valuable object is received in said valuable object receiving portion.

60. The flipped ball game apparatus according to claim 58, wherein said valuable object using operation determining means includes, a game starting operation portion operated by a player to start a game, and starting operation detecting means for detecting that said game starting operation portion is operated.

61. The flipped ball game apparatus according to claim 36, wherein said coefficient setting means includes, coefficient inputting means provided in a position where said coefficient inputting means can be operated by a player, for inputting a desired coefficient by the operation, and coefficient storing means for storing the coefficient input by said coefficient inputting means.

62. The flipped ball game apparatus according to claim 56, further comprising output means for outputting information generated with the play of a game, in a visually recognizable manner.

63. The flipped ball game apparatus according to claim 62, wherein said output means includes game number output means for outputting the number that said one-unit game is played.

64. The flipped ball game apparatus according to claim 62, wherein said output means includes game number per coefficient output means for outputting, for each coefficient set by said coefficient setting means, the number of the one-unit games played when the coefficient is being set.

* * * * *